US009390664B2

(12) United States Patent
Yamazaki et al.

(10) Patent No.: US 9,390,664 B2
(45) Date of Patent: Jul. 12, 2016

(54) LIQUID CRYSTAL DISPLAY DEVICE

(71) Applicant: Semiconductor Energy Laboratory Co., Ltd., Kanagawa-ken (JP)

(72) Inventors: Shunpei Yamazaki, Tokyo (JP); Jun Koyama, Kanagawa (JP); Yoshiharu Hirakata, Kanagawa (JP); Hiroyuki Miyake, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 253 days.

(21) Appl. No.: 13/950,951

(22) Filed: Jul. 25, 2013

(65) Prior Publication Data

US 2014/0028645 A1 Jan. 30, 2014

(30) Foreign Application Priority Data

Jul. 26, 2012 (JP) ..... 2012-165630

(51) Int. Cl.

| | |
|---|---|
| ***G09G 5/00*** | (2006.01) |
| ***G09G 3/36*** | (2006.01) |
| *G09G 3/34* | (2006.01) |

(52) U.S. Cl.

CPC ..... *G09G 3/3614* (2013.01); *G09G 3/36* (2013.01); *G09G 3/3406* (2013.01); *G09G 2310/0245* (2013.01); *G09G 2320/0261* (2013.01); *G09G 2320/046* (2013.01); *G09G 2320/0626* (2013.01); *G09G 2330/021* (2013.01); *G09G 2330/027* (2013.01)

(58) Field of Classification Search

None

See application file for complete search history.

(56) References Cited

U.S. PATENT DOCUMENTS

| | | | | |
|---|---|---|---|---|
| 5,731,856 | A | 3/1998 | Kim et al. | |
| 5,744,864 | A | 4/1998 | Cillessen et al. | |
| 5,821,910 | A | 10/1998 | Shay | |
| 5,900,886 | A | 5/1999 | Shay | |
| 6,005,543 | A | 12/1999 | Kimura | |
| 6,166,714 | A | 12/2000 | Kishimoto | |
| 6,294,274 | B1 | 9/2001 | Kawazoe et al. | |
| 6,317,109 | B1 | 11/2001 | Lee | |
| 6,452,579 | B1 * | 9/2002 | Itoh et al. | 345/100 |
| 6,496,172 | B1 | 12/2002 | Hirakata | |

(Continued)

FOREIGN PATENT DOCUMENTS

| | | | |
|---|---|---|---|
| EP | 1737044 | A | 12/2006 |
| EP | 2226847 | A | 9/2010 |

(Continued)

OTHER PUBLICATIONS

Fortunato.E et al., "Wide-Bandgap High-Mobility ZnO Thin-Film Transistors Produced at Room Temperature," Appl. Phys. Lett. (Applied Physics Letters, Sep. 27, 2004, vol. 85, No. 13, pp. 2541-2543.

(Continued)

*Primary Examiner* — Adam R Giesy
*Assistant Examiner* — Henok Heyi
(74) *Attorney, Agent, or Firm* — Husch Blackwell LLP

(57) ABSTRACT

A liquid crystal display device includes a plurality of pixels each including a transistor and a liquid crystal element, and a driver circuit that inputs at least a video signal and a reset signal to the plurality of pixels. The driver circuit makes the polarity of the video signal inverted every m frames (m is a natural number of 2 or more) and inputs the inverted video signal to the pixel, and inputs the reset signal to the pixel while not inputting the video signal.

13 Claims, 15 Drawing Sheets

(56) References Cited

U.S. PATENT DOCUMENTS

| | | | | |
|---|---|---|---|---|
| 6,535,191 | B1 | 3/2003 | Miyachi | |
| 6,563,174 | B2 | 5/2003 | Kawasaki et al. | |
| 6,590,552 | B1 | 7/2003 | Yokoyama et al. | |
| 6,727,522 | B1 | 4/2004 | Kawasaki et al. | |
| 7,002,541 | B2 | 2/2006 | Yanagi et al. | |
| 7,049,190 | B2 | 5/2006 | Takeda et al. | |
| 7,061,014 | B2 | 6/2006 | Hosono et al. | |
| 7,064,346 | B2 | 6/2006 | Kawasaki et al. | |
| 7,105,868 | B2 | 9/2006 | Nause et al. | |
| 7,211,825 | B2 | 5/2007 | Shih et al | |
| 7,282,782 | B2 | 10/2007 | Hoffman et al. | |
| 7,297,977 | B2 | 11/2007 | Hoffman et al. | |
| 7,321,353 | B2 | 1/2008 | Tsuda et al. | |
| 7,323,356 | B2 | 1/2008 | Hosono et al. | |
| 7,385,224 | B2 | 6/2008 | Ishii et al. | |
| 7,402,506 | B2 | 7/2008 | Levy et al. | |
| 7,411,209 | B2 | 8/2008 | Endo et al. | |
| 7,453,065 | B2 | 11/2008 | Saito et al. | |
| 7,453,087 | B2 | 11/2008 | Iwasaki | |
| 7,462,862 | B2 | 12/2008 | Hoffman et al. | |
| 7,468,304 | B2 | 12/2008 | Kaji et al. | |
| 7,501,293 | B2 | 3/2009 | Ito et al. | |
| 7,674,650 | B2 | 3/2010 | Akimoto et al. | |
| 7,732,819 | B2 | 6/2010 | Akimoto et al. | |
| 2001/0024187 | A1 | 9/2001 | Sato et al. | |
| 2001/0046027 | A1 | 11/2001 | Tai et al. | |
| 2002/0056838 | A1 | 5/2002 | Ogawa | |
| 2002/0075205 | A1 | 6/2002 | Kimura et al. | |
| 2002/0080131 | A1 | 6/2002 | Fujino | |
| 2002/0093473 | A1 | 7/2002 | Tanaka et al. | |
| 2002/0132454 | A1 | 9/2002 | Ohtsu et al. | |
| 2002/0180675 | A1 | 12/2002 | Tobita et al. | |
| 2003/0156104 | A1 | 8/2003 | Morita | |
| 2003/0189401 | A1 | 10/2003 | Kido et al. | |
| 2003/0209989 | A1* | 11/2003 | Anzai et al. | 315/169.3 |
| 2003/0218222 | A1 | 11/2003 | Wager et al. | |
| 2004/0038446 | A1 | 2/2004 | Takeda et al. | |
| 2004/0127038 | A1 | 7/2004 | Carcia et al. | |
| 2004/0252115 | A1 | 12/2004 | Boireau | |
| 2005/0017302 | A1 | 1/2005 | Hoffman | |
| 2005/0140699 | A1 | 6/2005 | Ito | |
| 2005/0199959 | A1 | 9/2005 | Chiang et al. | |
| 2006/0035452 | A1 | 2/2006 | Carcia et al. | |
| 2006/0043377 | A1 | 3/2006 | Hoffman et al. | |
| 2006/0091793 | A1 | 5/2006 | Baude et al. | |
| 2006/0108529 | A1 | 5/2006 | Saito et al. | |
| 2006/0108636 | A1 | 5/2006 | Sano et al. | |
| 2006/0110867 | A1 | 5/2006 | Yabuta et al. | |
| 2006/0113536 | A1 | 6/2006 | Kumomi et al. | |
| 2006/0113539 | A1 | 6/2006 | Sano et al. | |
| 2006/0113549 | A1 | 6/2006 | Den et al. | |
| 2006/0113565 | A1 | 6/2006 | Abe et al. | |
| 2006/0119755 | A1 | 6/2006 | Senda et al. | |
| 2006/0139289 | A1* | 6/2006 | Yoshida et al. | 345/98 |
| 2006/0163583 | A1 | 7/2006 | Jiroku | |
| 2006/0169973 | A1 | 8/2006 | Isa et al. | |
| 2006/0170111 | A1 | 8/2006 | Isa et al. | |
| 2006/0197092 | A1 | 9/2006 | Hoffman et al. | |
| 2006/0208977 | A1 | 9/2006 | Kimura | |
| 2006/0228974 | A1 | 10/2006 | Thelss et al. | |
| 2006/0231882 | A1 | 10/2006 | Kim et al. | |
| 2006/0238135 | A1 | 10/2006 | Kimura | |
| 2006/0244107 | A1 | 11/2006 | Sugihara et al. | |
| 2006/0284171 | A1 | 12/2006 | Levy et al. | |
| 2006/0284172 | A1 | 12/2006 | Ishii | |
| 2006/0292777 | A1 | 12/2006 | Dunbar | |
| 2007/0001963 | A1 | 1/2007 | Koma | |
| 2007/0024187 | A1 | 2/2007 | Shin et al. | |
| 2007/0046191 | A1 | 3/2007 | Saito | |
| 2007/0052025 | A1 | 3/2007 | Yabuta | |
| 2007/0054507 | A1 | 3/2007 | Kaji et al. | |
| 2007/0080909 | A1 | 4/2007 | Jeon et al. | |
| 2007/0090365 | A1 | 4/2007 | Hayashi et al. | |
| 2007/0108446 | A1 | 5/2007 | Akimoto | |
| 2007/0152217 | A1 | 7/2007 | Lai et al. | |
| 2007/0152921 | A1 | 7/2007 | Osame | |
| 2007/0172591 | A1 | 7/2007 | Seo et al. | |
| 2007/0187678 | A1 | 8/2007 | Hirao et al. | |
| 2007/0187760 | A1 | 8/2007 | Furuta et al. | |
| 2007/0194379 | A1 | 8/2007 | Hosono et al. | |
| 2007/0252928 | A1 | 11/2007 | Ito et al. | |
| 2007/0272922 | A1 | 11/2007 | Kim et al. | |
| 2007/0273682 | A1 | 11/2007 | Yi et al. | |
| 2007/0287296 | A1 | 12/2007 | Chang | |
| 2008/0006877 | A1 | 1/2008 | Mardilovich et al. | |
| 2008/0038882 | A1 | 2/2008 | Takechi et al. | |
| 2008/0038929 | A1 | 2/2008 | Chang | |
| 2008/0050595 | A1 | 2/2008 | Nakagawara et al. | |
| 2008/0073653 | A1 | 3/2008 | Iwasaki | |
| 2008/0083950 | A1 | 4/2008 | Pan et al. | |
| 2008/0106191 | A1 | 5/2008 | Kawase | |
| 2008/0128689 | A1 | 6/2008 | Lee et al. | |
| 2008/0129195 | A1 | 6/2008 | Ishizaki et al. | |
| 2008/0166834 | A1 | 7/2008 | Kim et al. | |
| 2008/0182358 | A1 | 7/2008 | Cowdery-Corvan et al. | |
| 2008/0224133 | A1 | 9/2008 | Park et al. | |
| 2008/0224904 | A1 | 9/2008 | Fujimura | |
| 2008/0254569 | A1 | 10/2008 | Hoffman et al. | |
| 2008/0258139 | A1 | 10/2008 | Ito et al. | |
| 2008/0258140 | A1 | 10/2008 | Lee et al. | |
| 2008/0258141 | A1 | 10/2008 | Park et al. | |
| 2008/0258143 | A1 | 10/2008 | Kim et al. | |
| 2008/0296568 | A1 | 12/2008 | Ryu et al. | |
| 2009/0015533 | A1 | 1/2009 | Fujita et al. | |
| 2009/0058888 | A1 | 3/2009 | Chou et al. | |
| 2009/0068773 | A1 | 3/2009 | Lai et al. | |
| 2009/0072226 | A1 | 3/2009 | Koo et al. | |
| 2009/0073325 | A1 | 3/2009 | Kuwabara et al. | |
| 2009/0114910 | A1 | 5/2009 | Chang | |
| 2009/0134399 | A1 | 5/2009 | Sakakura et al. | |
| 2009/0152506 | A1 | 6/2009 | Umeda et al. | |
| 2009/0152541 | A1 | 6/2009 | Maekawa et al. | |
| 2009/0213042 | A1 | 8/2009 | Hagino et al. | |
| 2009/0278122 | A1 | 11/2009 | Hosono et al. | |
| 2009/0280600 | A1 | 11/2009 | Hosono et al. | |
| 2009/0310077 | A1 | 12/2009 | Kim et al. | |
| 2010/0007640 | A1* | 1/2010 | Suguro | 345/208 |
| 2010/0033414 | A1 | 2/2010 | Jeong et al. | |
| 2010/0065844 | A1 | 3/2010 | Tokunaga | |
| 2010/0066724 | A1 | 3/2010 | Huh et al. | |
| 2010/0092800 | A1 | 4/2010 | Itagaki et al. | |
| 2010/0109002 | A1 | 5/2010 | Itagaki et al. | |
| 2010/0109990 | A1* | 5/2010 | Harada | 345/87 |
| 2010/0123711 | A1 | 5/2010 | Kawabe | |
| 2010/0315396 | A1 | 12/2010 | Weng et al. | |
| 2011/0090183 | A1 | 4/2011 | Yamazaki et al. | |
| 2011/0141098 | A1* | 6/2011 | Yaguma et al. | 345/212 |
| 2011/0148846 | A1 | 6/2011 | Arasawa et al. | |
| 2011/0157131 | A1 | 6/2011 | Miyake | |
| 2011/0199404 | A1 | 8/2011 | Umezaki et al. | |
| 2011/0210957 | A1 | 9/2011 | Koyama et al. | |
| 2011/0285759 | A1 | 11/2011 | Sakai | |
| 2012/0001874 | A1* | 1/2012 | Kurokawa et al. | 345/175 |
| 2012/0188290 | A1* | 7/2012 | Park et al. | 345/690 |
| 2014/0015819 | A1 | 1/2014 | Yamazaki et al. | |
| 2014/0015868 | A1 | 1/2014 | Yamazaki et al. | |

FOREIGN PATENT DOCUMENTS

| | | | |
|---|---|---|---|
| JP | 60-198861 | A | 10/1985 |
| JP | 63-210022 | A | 8/1988 |
| JP | 63-210023 | A | 8/1988 |
| JP | 63-210024 | A | 8/1988 |
| JP | 63-215519 | A | 9/1988 |
| JP | 63-239117 | A | 10/1988 |
| JP | 63-265818 | A | 11/1988 |
| JP | 5-251705 | A | 9/1993 |
| JP | 8-264794 | A | 10/1996 |
| JP | 11-505377 | | 5/1999 |
| JP | 2000-044236 | A | 2/2000 |
| JP | 2000-150900 | A | 5/2000 |
| JP | 2002-076356 | A | 3/2002 |
| JP | 2002-289859 | A | 10/2002 |
| JP | 2002-323879 | | 11/2002 |

(56) References Cited

FOREIGN PATENT DOCUMENTS

| | | | |
|---|---|---|---|
| JP | 2003-086000 | A | 3/2003 |
| JP | 2003-086808 | A | 3/2003 |
| JP | 2004-103957 | A | 4/2004 |
| JP | 2004-273614 | A | 9/2004 |
| JP | 2004-273732 | A | 9/2004 |
| WO | WO 2004/114391 | | 12/2004 |
| WO | WO 2005/033785 | A1 | 4/2005 |

OTHER PUBLICATIONS

Dembo.H et al., "RFCPUS on Glass and Plastic Substrates Fabricated by TFT Transfer Technology,", IEDM 05: Technical Digest of International Electron Devices Meeting, Dec. 5, 2005, pp. 1067-1069.

Ikeda.T et al., "Full-Functional System Liquid Crystal Display Using CG-Silicon Technology,", SID Digest '04 : SID International Symposium Digest of Technical Papers, 2004, vol. 35, pp. 860-863.

Nomura.K et al., "Room-Temperature Fabrication of Transparent Flexible Thin-Film Transistors Using Amorphous Oxide Semiconductors,", Nature, Nov. 25, 2004, vol. 432, pp. 488-492.

Park.J et al., "Improvements in the Device Characteristics of Amorphous Indium Gallium Zinc Oxide Thin-Film Transistors by Ar Plasma Treatment,", Appl. Phys. Lett. (Applied Physics Letters) , Jun. 26, 2007, vol. 90, No. 26, pp. 262106-1-262106-3.

Takahashi.M et al., "Theoretical Analysis of IGZO Transparent Amorphous Oxide Semiconductor,", IDW '08 : Proceedings of the 15th International Display Workshops, Dec. 3, 2008, pp. 1637-1640.

Hayashi.R et al., "42.1: Invited Paper: Improved Amorphous In—Ga—Zn—O TFTs,", SID Digest '08 : SID International Symposium Digest of Technical Papers, May 20, 2008, vol. 39, pp. 621-624.

Prins.M et al., "A Ferroelectric Transparent Thin-Film Transistor,", Appl. Phys. Lett. (Applied Physics Letters) , Jun. 17, 1996, vol. 68, No. 25, pp. 3650-3652.

Nakamura.M et al., "The phase relations in the In2O3—Ga2ZnO4—ZnO system at 1350° C.,", Journal of Solid State Chemistry, Aug. 1, 1991, vol. 93, No. 2, pp. 298-315.

Kimizuka.N et al., "Syntheses and Single-Crystal Data of Homologous Compounds, In2O3(ZnO)m (m = 3, 4, and 5), InGaO3(ZnO)3, and Ga2O3(ZnO)m (m = 7, 8, 9, and 16) in the In2O3—ZnGa2O4—ZnO System,", Journal of Solid State Chemistry, Apr. 1, 1995, vol. 116, No. 1, pp. 170-178.

Nomura.K et al., "Thin-Film Transistor Fabricated in Single-Crystalline Transparent Oxide Semiconductor,", Science, May 23, 2003, vol. 300, No. 5623, pp. 1269-1272.

Masuda.S et al., "Transparent thin film transistors using ZnO as an active channel layer and their electrical properties,", J. Appl. Phys. (Journal of Applied Physics) , Feb. 1, 2003, vol. 93, No. 3, pp. 1624-1630.

Asakuma.N. et al., "Crystallization and Reduction of Sol-Gel-Derived Zinc Oxide Films by Irradiation With Ultraviolet Lamp,", Journal of Sol-Gel Science and Technology, 2003, vol. 26, pp. 181-184.

Osada.T et al., "15.2: Development of Driver-Integrated Panel using Amorphous In—Ga—Zn—Oxide TFT,", SID Digest '09 : SID International Symposium Digest of Technical Papers, May 31, 2009, pp. 184-187.

Nomura.K et al., "Carrier transport in transparent oxide semiconductor with intrinsic structural randomness probed using single-crystalline InGaO3(ZnO)5 films,", Appl. Phys. Lett. (Applied Physics Letters) , Sep. 13, 2004, vol. 85, No. 11, pp. 1993-1995.

Li.C et al., "Modulated Structures of Homologous Compounds InMO3(ZnO)m (M=In,Ga; m=Integer) Described by Four-Dimensional Superspace Group,", Journal of Solid State Chemistry, 1998, vol. 139, pp. 347-355.

Son.K et al., "42.4L: Late-News Paper: 4 Inch QVGA AMOLED Driven by the Threshold Voltage Controlled Amorphous GIZO (Ga2O3—In2O3—ZnO) TFT,", SID Digest '08 : SID International Symposium Digest of Technical Papers, May 20, 2008, vol. 39, pp. 633-636.

Lee.J et al., "World's Largest (15-Inch) XGA AMLCD Panel Using IGZO Oxide TFT,", SID Digest '08 : SID International Symposium Digest of Technical Papers, May 20, 2008, vol. 39, pp. 625-628.

Nowatari.H et al., "60.2: Intermediate Connector With Suppressed Voltage Loss for White Tandem OLEDs,", SID Digest '09 : SID International Symposium Digest of Technical Papers, May 31, 2009, vol. 40, pp. 899-902.

Kanno.H et al., "White Stacked Electrophosphorecent Organic Light-Emitting Devices Employing MOO3 as a Charge-Generation Layer,", Adv. Mater. (Advanced Materials), 2006, vol. 18, No. 3, pp. 339-342.

Van de Walle.C, "Hydrogen as a Cause of Doping in Zinc Oxide,", Phys. Rev. Lett. (Physical Review Letters), Jul. 31, 2000, vol. 85, No. 5, pp. 1012-1015.

Fung.T et al., "2-D Numerical Simulation of High Performance Amorphous In—Ga—Zn-O TFTs for Flat Panel Displays,", AM-FPD '08 Digest of Technical Papers, Jul. 2, 2008, pp. 251-252, The Japan Society of Applied Physics.

Jeong.J et al., "3.1: Distinguished Paper: 12.1-Inch WXGA AMOLED Display by Indium—Gallium—Zinc Oxide TFTs Array,", SID Digest '08 : SID International Symposium Digest of Technical Papers, May 20, 2008, vol. 39, No. 1, pp. 1-4.

Park.J et al., "High performance amorphous oxide thin film transistors with self-aligned top-gate structure,", IEDM 09: Technical Digest of International Electron Devices Meeting, Dec. 7, 2009, pp. 191-194.

Kurokawa.Y et al., "UHF RFCPUS on Flexible and Glass Substrates for Secure RFID Systems,", Journal of Solid-State Circuits , 2008, vol. 43, No. 1, pp. 292-299.

Ohara.H et al., "Amorphous In—Ga—Zn—Oxide TFTs with Suppressed Variation for 4.0 inch QVGA AMOLED Display,", AM-FPD '09 Digest of Technical Papers, Jul. 1, 2009, pp. 227-230, The Japan Society of Applied Physics.

Coates.D et al., "Optical Studies of the Amorphous Liquid-Cholesteric Liquid Crystal Transition:The "Blue Phase",", Physics Letters, Sep. 10, 1973, vol. 45A, No. 2, pp. 115-116.

Cho.D et al., "21.2:Al and Sn-Doped Zinc Indium Oxide Thin Film Transistors for AMOLED Back-Plane,", SID Digest '09 : SID International Symposium Digest of Technical Papers, May 31, 2009, pp. 280-283.

Lee.M et al., "15.4:Excellent Performance of Indium—Oxide-Based Thin-Film Transistors by DC Sputtering,", SID Digest '09 : SID International Symposium Digest of Technical Papers, May 31, 2009, pp. 191-193.

Jin.D et al., "65.2:Distinguished Paper:World-Largest (6.5") Flexible Full Color Top.Emission AMOLED Display on Plastic Film and Its Bending Properties,", SID Digest '09 : SID International Symposium Digest of Technical Papers, May 31, 2009, pp. 983-985.

Sakata.J et al., "Development of 4.0-In. AMOLED Display With Driver Circuit Using Amorphous In—Ga—Zn—Oxide TFTs,", IDW '09 : Proceedings of the 16th International Display Workshops, 2009, pp. 689-692.

Park.J et al., "Amorphous Indium—Gallium—Zinc Oxide TFTs and Their Application for Large Size AMOLED,", AM-FPD '08 Digest of Technical Papers, Jul. 2, 2008, pp. 275-278.

Park.S et al., "Challenge to Future Displays: Transparent AM-OLED Driven by PEALD Grown ZnO TFT,", IMID '07 Digest, 2007, pp. 1249-1252.

Godo.H et al., "Temperature Dependence of Characteristics and Electronic Structure for Amorphous In—Ga—Zn—Oxide TFT,", AM-FPD '09 Digest of Technical Papers, Jul. 1, 2009, pp. 41-44.

Osada.T et al., "Development of Driver-Integrated Panel Using Amorphous In—Ga—Zn—Oxide TFT,", AM-FPD '09 Digest of Technical Papers, Jul. 1, 2009, pp. 33-36.

Hirao.T et al., "Novel Top-Gate Zinc Oxide Thin-Film Transistors (ZnO TFTs) for AMLCDs,", Journal of the SID, 2007, vol. 15, No. 1, pp. 17-22.

Hosono.H, "68.3:Invited Paper:Transparent Amorphous Oxide Semiconductors for High Performance TFT,", SID Digest '07 : SID International Symposium Digest of Technical Papers, 2007, vol. 38, pp. 1830-1833.

Godo.H et al., "P-9:Numerical Analysis on Temperature Dependence of Characteristics of Amorphous In—Ga—Zn—Oxide TFT,", SID

(56) References Cited

OTHER PUBLICATIONS

Digest '09 : SID International Symposium Digest of Technical Papers, May 31, 2009, pp. 1110-1112.
Ohara.H et al., "21.3:4.0 In. QVGA AMOLED Display Using In—Ga—Zn—Oxide TFTs With a Novel Passivation Layer,", SID Digest '09 : SID International Symposium Digest of Technical Papers, May 31, 2009, pp. 284-287.
Miyasaka.M, "SUFTLA Flexible Microelectronics on Their Way to Business,", SID Digest '07 : SID International Symposium Digest of Technical Papers, 2007, vol. 38, pp. 1673-1676.
Chern.H et al., "An Analytical Model for the Above-Threshold Characteristics of Polysilicon Thin-Film Transistors,", IEEE Transactions on Electron Devices, Jul. 1, 1995, vol. 42, No. 7, pp. 1240-1246.
Kikuchi.H et al., "39.1:Invited Paper:Optically Isotropic Nano-Structured Liquid Crystal Composites for Display Applications,", SID Digest '09 : SID International Symposium Digest of Technical Papers, May 31, 2009, pp. 578-581.
Asaoka.Y et al., "29.1:Polarizer-Free Reflective LCD Combined With Ultra Low-Power Driving Technology,", SID Digest '09 : SID International Symposium Digest of Technical Papers, May 31, 2009, pp. 395-398.
Lee.H et al., "Current Status of, Challenges to, and Perspective View of AM-OLED ,", IDW '06.: Proceedings of the 13th International Display Workshops, Dec. 7, 2006, pp. 663-666.
Kikuchi.H et al., "62.2:Invited Paper:Fast Electro-Optical Switching in Polymer-Stabilized Liquid Crystalline Blue Phases for Display Application,", SID Digest '07 : SID International Symposium Digest of Technical Papers, 2007, vol. 38, pp. 1737-1740.
Nakamura.M, "Synthesis of Homologous Compound with New Long-Period Structure,", NIRIM Newsletter, Mar. 1, 1995, vol. 150, pp. 1-4.
Kikuchi.H et al., "Polymer-Stabilized Liquid Crystal Blue Phases,", Nature Materials, Sep. 2, 2002, vol. 1, pp. 64-68.
Kimizuka.N. et al., "Spinel,YbFe2O4, and Yb2Fe3O7 Types of Structures for Compounds in the In2O3 and Sc2O3—A2O3—Bo Systems [A; Fe, Ga, or Al; B: Mg, Mn, Fe, Ni, Cu,or Zn] at Temperatures Over 1000° C.,", Journal of Solid State Chemistry, 1985, vol. 60, pp. 382-384.
Kitzerow.H et al., "Observation of Blue Phases in Chiral Networks,", Liquid Crystals, 1993, vol. 14, No. 3, pp. 911-916.
Costello.M et al., "Electron Microscopy of a Cholesteric Liquid Crystal and Its Blue Phase,", Phys. Rev. A (Physical Review. A), May 1, 1984, vol. 29, No. 5, pp. 2957-2959.
Meiboom.S et al., "Theory of the Blue Phase of Cholesteric Liquid Crystals,", Phys. Rev. Lett. (Physical Review Letters), May 4, 1981, vol. 46, No. 18, pp. 1216-1219.
Park.Sang-Hee et al., "42.3: Transparent ZnO Thin Film Transistor for the Application of High Aperture Ratio Bottom Emission AM-OLED Display,", SID Digest '08 : SID International Symposium Digest of Technical Papers, May 20, 2008, vol. 39, pp. 629-632.
Orita.M et al., "Mechanism of Electrical Conductivity of Transparent InGaZnO4,", Phys. Rev. B (Physical Review. B), Jan. 15, 2000, vol. 61, No. 3, pp. 1811-1816.
Nomura.K et al., "Amorphous Oxide Semiconductors for High-Performance Flexible Thin- Film Transistors,", Jpn. J. Appl. Phys. (Japanese Journal of Applied Physics) , 2006, vol.45, No. 5B, pp. 4303-4308.
Janotti.A et al., "Native Point Defects in ZnO,", Phys. Rev. B (Physical Review. B), Oct. 4, 2007, vol. 76, No. 16, pp. 165202-1-165202-22.
Park.J et al., "Electronic Transport Properties of Amorphous Indium—Gallium—Zinc Oxide Semiconductor Upon Exposure to Water,", Appl. Phys. Lett. (Applied Physics Letters) , 2008, vol. 92, pp. 072104-1-072104-3.
Hsieh.H et al., "P-29:Modeling of Amorphous Oxide Semiconductor Thin Film Transistors and Subgap Density of States,", SID Digest '08 : SID International Symposium Digest of Technical Papers, 2008, vol. 39, pp. 1277-1280.
Janotti.A et al., "Oxygen Vacancies in ZnO,", Appl. Phys. Lett. (Applied Physics Letters) , 2005, vol. 87, pp. 122102-1-122102-3.
Oba.F et al., "Defect energetics in ZnO: A hybrid Hartree-Fock density functional study,", Phys. Rev. B (Physical Review. B), 2008, vol. 77, pp. 245202-1-245202-6.
Orita.M et al., "Amorphous transparent conductive oxide InGaO3(ZnO)m (m<4):a Zn4s conductor,", Philosophical Magazine, 2001, vol. 81, No. 5, pp. 501-515.
Hosono.H et al., "Working hypothesis to explore novel wide band gap electrically conducting amorphous oxides and examples,", J. Non-Cryst. Solids (Journal of Non-Crystalline Solids), 1996, vol. 198-200, pp. 165-169.
Mo.Y et al., "Amorphous Oxide TFT Backplanes for Large Size AMOLED Displays,", IDW '08 : Proceedings of the 6th International Display Workshops, Dec. 3, 2008, pp. 581-584.
Kim.S et al., "High-Performance oxide thin film transistors passivated by various gas plasmas,", 214th ECS Meeting, 2008, No. 2317, ECS.
Clark.S et al., "First Principles Methods Using CASTEP,", Zeitschrift fur Kristallographie, 2005, vol. 220, pp. 567-570.
Lany.S et al., "Dopability, Intrinsic Conductivity, and Nonstoichiometry of Transparent Conducting Oxides,", Phys. Rev. Lett. (Physical Review Letters), Jan. 26, 2007, vol. 98, pp. 045501-1-045501-4.
Park.J et al., "Dry etching of ZnO films and plasma-induced damage to optical properties,", J. Vac. Sci.Technol. B (Journal of Vacuum Science & Technology B), Mar. 1, 2003, vol. 21, No. 2, pp. 800-803.
Oh.M et al., "Improving the Gate Stability of ZnO Thin-Film Transistors With Aluminum Oxide Dielectric Layers,", J. Electrochem. Soc. (Journal of the Electrochemical Society), 2008, vol. 155, No. 12, pp. H1009-H1014.
Ueno.K et al., "Field-Effect Transistor on SrTiO3 With Sputtered Al2O3 Gate Insulator,", Appl. Phys. Lett. (Applied Physics Letters) , Sep. 1, 2003, vol. 83, No. 9, pp. 1755-1757.
Tsuda, K. et al., "Ultra Low Power Consumption Technologies for Mobile TFT-LCDs," IDW '02: Proceedings of the 9th International Display Workshops, Dec. 4, 2002, pp. 295-298.

* cited by examiner

LIQUID CRYSTAL DISPLAY DEVICE

BACKGROUND OF THE INVENTION

1. Field of the Invention

The present invention relates to a liquid crystal display device and a method for driving the liquid crystal display device.

2. Description of the Related Art

A technique for forming a thin film transistor (TFT) with the use of a semiconductor thin film formed over a substrate having an insulating surface has attracted attention. Thin film transistors are applied to a wide range of electronic devices such as integrated circuits (ICs) and image display devices (display devices).

An example of a display device including thin film transistors is an active matrix liquid crystal display device in which a thin film transistor is provided as a switching element in each pixel. Liquid crystal display devices are used in various fields ranging from portable devices such as mobile phones and notebook computers to large devices such as televisions. The reduction in power consumption is recognized as a major challenge for such electronic devices including a liquid crystal display device. For example, lower power consumption of a portable device leads to longer continuous operation time, and lower power consumption of a large television or the like saves money in electricity.

In a liquid crystal display device, video signals are always rewritten even while still images are displayed, and the rewriting operation consumes power. As a method for reducing such power consumption, for example, there has been reported a technique in which in still image display, an idle period that is longer than a scan period is provided as a non-scan period each time after a screen is scanned once to write video signals (e.g., see Patent Document 1 and Non-Patent Document 1).

REFERENCE

Patent Document 1: U.S. Pat. No. 7,321,353

Non-Patent Document 1: K. Tsuda et al., IDW'02, Proc., pp. 295-298

SUMMARY OF THE INVENTION

However, the above function of the liquid crystal display device works only in still image display, and an idle period cannot be provided in moving image display; thus, power consumption cannot be reduced.

In view of the foregoing problem, an object of one embodiment of the disclosed invention is to provide a liquid crystal display device in which low power consumption is achieved even in moving image display. In particular, an object is to provide a liquid crystal display device in which power consumption is low even in moving image display and deterioration of liquid crystal elements is suppressed.

One embodiment of the disclosed invention is a liquid crystal display device that includes a plurality of pixels each including a transistor and a liquid crystal element electrically connected to the transistor, and a driver circuit configured to input at least a video signal and a reset signal to the plurality of pixels. The driver circuit makes the polarity of the video signal inverted every m frames (m is a natural number of 2 or more) and inputs the inverted video signal to the pixels. The driver circuit inputs the reset signal to the pixels while not inputting the video signal.

In the above liquid crystal display device, the driver circuit preferably inputs, to the pixels, the reset signal that has a potential approximately the same as a common potential after a period during which the potential is higher than the common potential and a period during which the potential is lower than the common potential are repeated at least one time. It is preferable that the transistor in the pixel be turned off after making a potential difference between a pair of electrodes of the liquid crystal element in the pixel approximately 0 V by inputting the reset signal. It is preferable that supply of power be interrupted after the driver circuit inputs the reset signal to all the plurality of pixels.

It is preferable that the above liquid crystal display device also include a backlight emitting light to the plurality of pixels and that the driver circuit input the reset signal to the pixels while the backlight does not emit light. The driver circuit preferably inputs the reset signal to the pixels at the same time as when data in all the pixels are rewritten. Further, it is possible that the liquid crystal display device also includes a timer for activating the liquid crystal display device at a set time, and the driver circuit inputs the reset signal to the pixels when the liquid crystal display device is activated from a power-off state by the timer.

A transistor including an oxide semiconductor is preferably used as the transistor.

Note that in this specification and the like, the term "approximately the same potential" means not only exactly the same potential but also a potential with negligible difference. Further, in this specification and the like, the expression "the potential difference is made approximately 0 V" means not only that the potential difference is made exactly 0 V but also that a negligible potential difference is applied.

Note that in this specification and the like, the term "over" or "below" does not necessarily mean that a component is placed "directly on" or "directly under" another component. For example, the expression "a gate electrode over a gate insulating layer" can mean the case where there is an additional component between the gate insulating layer and the gate electrode.

In this specification and the like, the term "electrode" or "wiring" does not limit a function of a component. For example, an "electrode" is sometimes used as part of a "wiring", and vice versa. Moreover, the term "electrode" or "wiring" can include the case where a plurality of "electrodes" or "wirings" are formed in an integrated manner.

Functions of a "source" and a "drain" are sometimes replaced with each other when a transistor of opposite polarity is used or when the direction of current flowing is changed in circuit operation, for example. Therefore, the terms "source" and "drain" can be replaced with each other in this specification and the like.

Note that in this specification and the like, the term "electrically connected" includes the case where components are connected through an object having any electric function. There is no particular limitation on an object having any electric function as long as electric signals can be transmitted and received between components that are connected through the object.

Examples of an object having any electric function are a switching element such as a transistor, a resistor, an inductor, a capacitor, and an element with a variety of functions as well as an electrode and a wiring.

One embodiment of the disclosed invention can provide a liquid crystal display device in which low power consumption is achieved even in moving image display, and in particular, can provide a liquid crystal display device in which power consumption is low even in moving image display and deterioration of liquid crystal is suppressed.

BRIEF DESCRIPTION OF THE DRAWINGS

In the accompanying drawings:

FIGS. 9A1 and 9A2 are top views and FIG. 9B is a cross-sectional view of a liquid crystal display device in one embodiment of the disclosed invention;

DETAILED DESCRIPTION OF THE INVENTION

Figure 1:
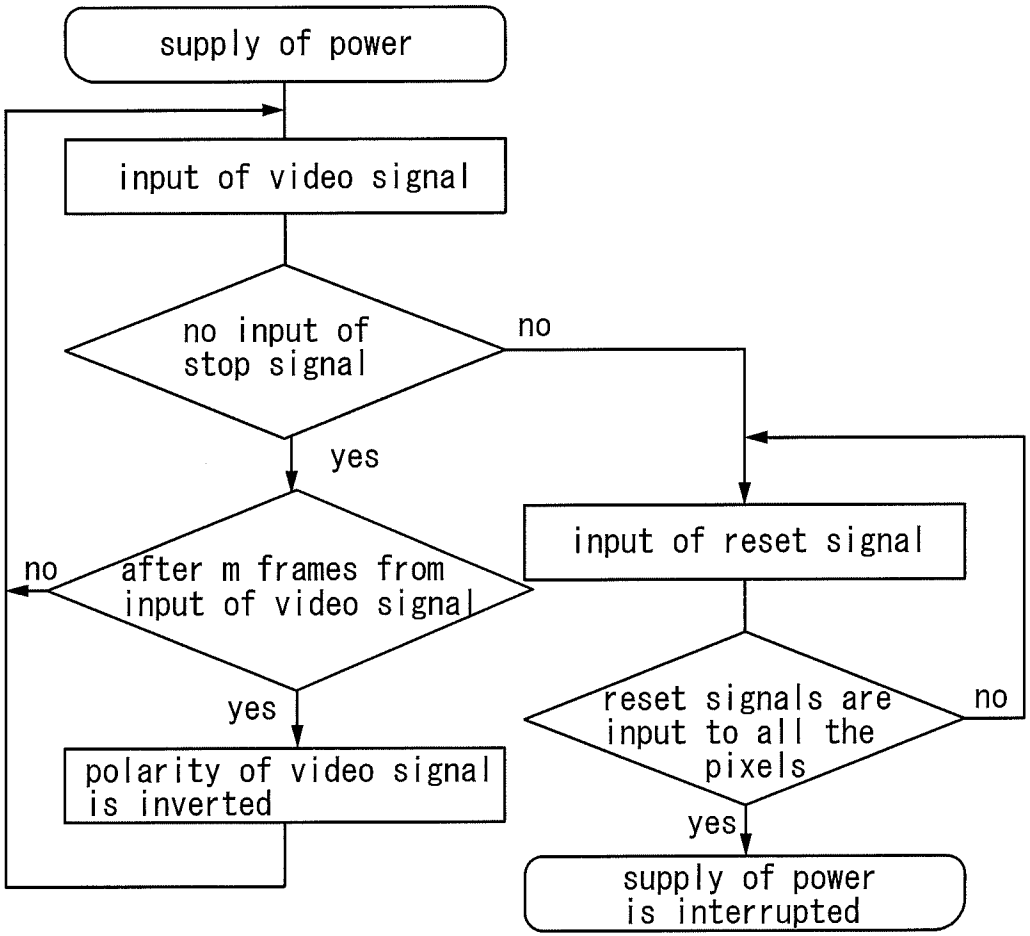
FIG. 1 is a flowchart showing operation of a liquid crystal display device in one embodiment of the disclosed invention.

Embodiments of the present invention will be described below in detail with reference to the accompanying drawings. Note that the present invention is not limited to the description below, and it is easily understood by those skilled in the art that modes and details can be modified in various ways without departing from the spirit and scope of the present invention. In addition, the present invention is not construed as being limited to the description of the embodiments.

Note that the size, layer thickness, signal waveform, and a region of each component illustrated in the drawings and the like in the embodiments are exaggerated for simplicity in some cases. Therefore, embodiments of the present invention are not limited to such scales.

Note that in this specification, ordinal numbers "first", "second", "third", and "N-th" (N is a natural number) are used in order to avoid confusion among components, and the terms do not limit the number of components.

(Embodiment 1)

In this embodiment, a liquid crystal display device in one embodiment of the disclosed invention and a method for driving the liquid crystal display device will be described with reference to FIG. 1, FIG. 2, FIGS. 3A and 3B, FIG. 4, FIGS. 5A and 5B, FIG. 6, FIGS. 7A and 7B, and FIG. 8.

First, the method for driving a liquid crystal display device shown in this embodiment will be described with reference to a flowchart in FIG. 1.

As shown in FIG. 1, in the liquid crystal display device of this embodiment, when supply of power is started, video signals are input to pixels from a driver circuit. The polarity of the inputted video signal is maintained for m frames (m is a natural number of 2 or more). In other words, the polarity of a video signal is inverted every m frames in the liquid crystal display device of this embodiment. Here, for example, an m-frame period is preferably about one second or less to suppress deterioration of liquid crystal. However, an m-frame period is not limited to the above and can be set as appropriate in accordance with voltage applied to a liquid crystal element, a liquid crystal material, or the like. Note that the polarity of a video signal can be determined based on the potential of a counter electrode (hereinafter referred to as common potential), for example.

Next, a video signal with inverted polarity is input to each pixel from the driver circuit, and the polarity of a video signal is inverted again after an m-frame period. Subsequently, a video signal is repeatedly input to each pixel from the driver circuit while its polarity is inverted every m frames, whereby images are displayed.

In conventional inversion driving per frame, when the level of voltage applied to a pixel is high, the amount of change in video signals is large because of signal inversion even if the level of the voltage does not change between frames; thus, power consumption is increased. On the other hand, in the method for driving the liquid crystal display device in this embodiment, video signals with the same polarity can be continuously written for an in-frame period or longer, so that the amount of change in video signals can be decreased to reduce power consumption. Further, the method for driving the liquid crystal display device can be employed to display both still images and moving images, leading to lower power consumption even in moving image display.

As described above, the liquid crystal display device in this embodiment can display images by input of video signals to the pixels from the driver circuit. To set the liquid crystal display device in a non-display state, a stop signal is input to the driver circuit, and the above-described input cycle of video signals is terminated. As shown in FIG. 1, when a stop signal is input to the driver circuit, a reset signal is input to each pixel from the driver circuit instead of a video signal. When reset signals are input to all the pixels, supply of power to the liquid crystal display device is interrupted.

Here, the stop signal is a signal for terminating an image display state of the liquid crystal display device and shifting the state to an image non-display state. For example, the stop signal may be a signal that can be transmitted with direct control by a remote controller, button operation, or the like; a signal that can be transmitted in response to measurements of a data signal that is the basis for a video signal, or the like; or a signal that can be transmitted in response to measurements of the amount of light from a backlight provided in the liquid crystal display device, for instance.

The reset signal is input to each pixel to suppress deterioration of liquid crystal. When an electric field with positive or negative polarity continues to be applied to a liquid crystal element for a long time, liquid crystal deteriorates and the electrical characteristics of the liquid crystal element become abnormal. As described above, in the method for driving the liquid crystal display device in this embodiment, video signals with the same polarity are continuously written for an m-frame period or longer; thus, an electric field of the same polarity is applied to the liquid crystal element for a longer time than that in the conventional driving method in which the polarity of a video signal is inverted every frame.

In the driving method of this embodiment, deterioration of liquid crystal is suppressed by input of the reset signal to a pixel after input of the stop signal. As the reset signal, a potential that is inverted between positive and negative polarities at least one time is preferably input, for example. In this case, the absolute values of the positive potential and the negative potential are preferably as large as possible. Note that like the polarity of a video signal, the polarity of the reset signal can be determined based on the common potential, for example. That is, in the reset signal, a period during which the potential is higher than the common potential and a period during which the potential is lower than the common potential are repeated at least one time.

After a potential that is inverted in polarity at least one time is input as the reset signal in the above manner, the potential of the reset signal is preferably set at approximately the same potential as the common potential. Further, after the potential difference between electrodes of the liquid crystal element is made approximately 0 V in this manner, it is preferable to turn off a transistor that is provided in a pixel and electrically connected to the liquid crystal element.

It is preferable that the backlight do not emit light when the reset signal is input. Inputting the reset signal with the backlight off can prevent disturbance of images due to input of the reset signal from being displayed. As described above, making the stop signal in conjunction with lighting of the backlight allows the reset signal to be easily input while the backlight does not emit light.

The reset signal is input before interrupt of supply of power to the liquid crystal display device in FIG. 1; however, the present invention is not limited to this. The reset signal can be input at the timing at which data in all the pixels in the liquid crystal display device are rewritten, for example, can be input when the liquid crystal display device displays a black image. Moreover, if the liquid crystal display device is used as a television set, for example, the reset signal can be input when channels or input devices are switched or when a program goes to a commercial break.

The liquid crystal display device can have a structure in which the reset signal is input at a time set by a timer while an image is not displayed, in order to suppress deterioration of liquid crystal. In this structure, the timer makes the liquid crystal display device activated at a specific time in which the liquid crystal display device is not in use (e.g., at a time in which a user does not usually use the liquid crystal display device, for example, at midnight), and then the reset signal is input. During input of the reset signal, it is preferable that the backlight do not emit light in order to prevent disturbance of images from being displayed.

By inputting the reset signal in the above manner, an electric field that is inverted in polarity is applied to a liquid crystal element at least once in a short time, so that deterioration of liquid crystal can be suppressed even when video signals with the same polarity are continuously written for an m-frame period or longer as described above.

In the above manner, it is possible to provide a liquid crystal display device in which power consumption is low even in moving image display. In particular, it is possible to provide a liquid crystal display device in which deterioration of liquid crystal is small while low power consumption is achieved even in moving image display.

An example of a structure and a driving method of a liquid crystal display device in this embodiment will be described below with reference to FIG. 2, FIGS. 3A and 3B, FIG. 4, FIGS. 5A and 5B, FIG. 6, FIGS. 7A and 7B, and FIG. 8.

Figure 2:
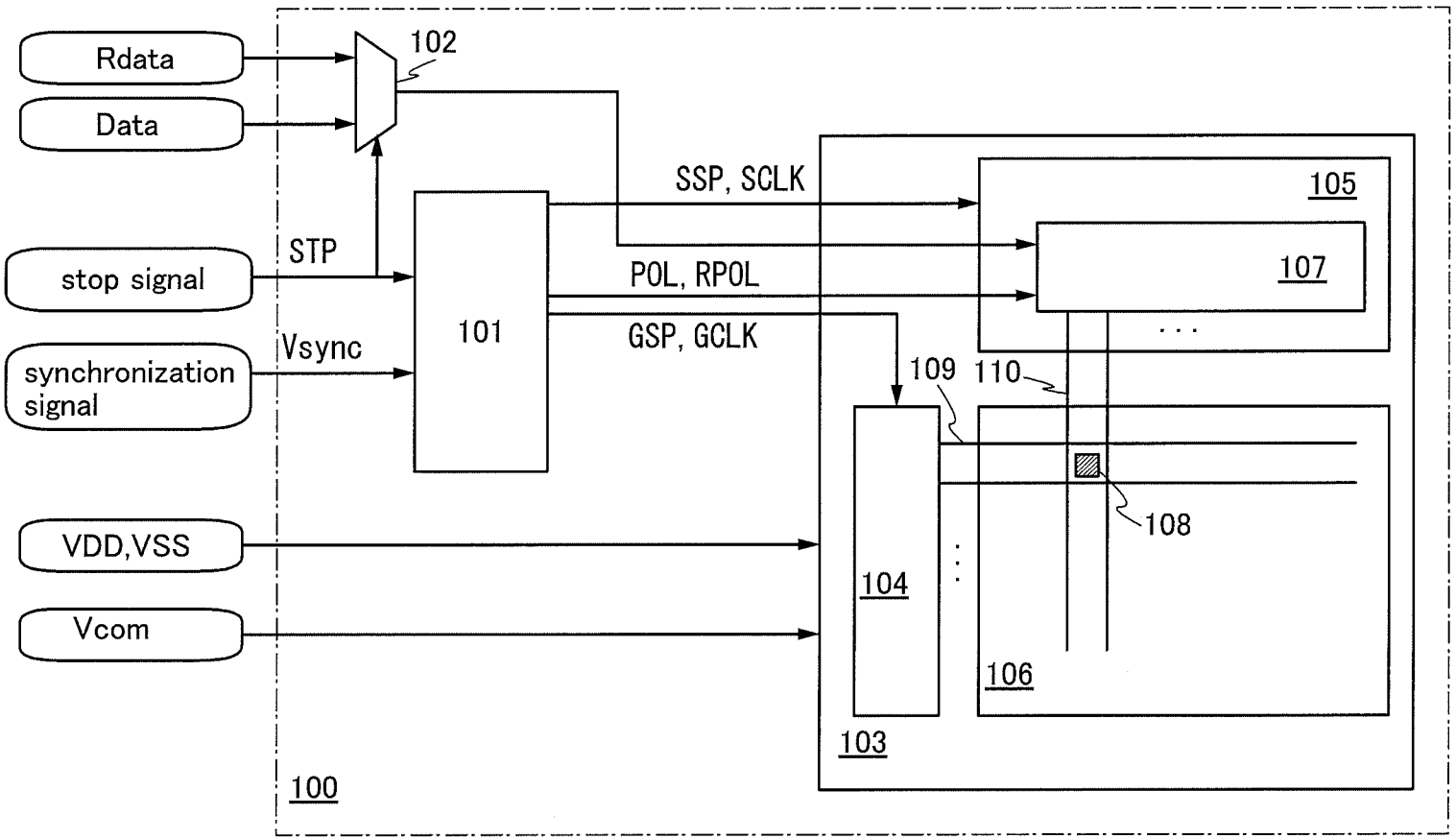
FIG. 2 is a block diagram illustrating a liquid crystal display device in one embodiment of the disclosed invention.

FIG. 2 is a block diagram of a liquid crystal display device 100 in one embodiment of the disclosed invention. The liquid crystal display device 100 includes a display control signal generator circuit 101, a selector circuit 102, and a display panel 103.

The display panel 103 includes a gate line driver circuit 104, a source line driver circuit 105, and a pixel portion 106. The pixel portion 106 includes a plurality of pixels 108, and each of the pixels 108 includes at least a liquid crystal element having a pair of electrodes. A video signal is supplied to a source line 110, and writing of the video signal into the pixel 108 is controlled with a scan line signal supplied from the gate line driver circuit 104 to a gate line 109. The source line driver circuit 105 preferably includes a digital/analog converter circuit 107. In this specification and the like, the term "driver circuit" includes the gate line driver circuit 104 and the source line driver circuit 105, and may also include the display control signal generator circuit 101, the selector circuit 102, and the like in some cases.

The display panel 103 is supplied with power supply voltage based on a high power supply potential VDD and a low power supply potential VSS, and a common potential Vcom.

The display control signal generator circuit 101 outputs signals for operating the gate line driver circuit 104 and the source line driver circuit 105 on the basis of a synchronization signal input from the outside.

Examples of the synchronization signal are a horizontal synchronization signal (Hsync), a vertical synchronization signal (Vsync), and a reference clock signal (CLK).

Examples of the signal for operating the gate line driver circuit 104 are a gate line start pulse GSP and a gate line clock signal GCLK. Note that the gate line clock signal GCLK includes a plurality of gate line clock signals obtained by phase shift.

Examples of the signal for operating the source line driver circuit 105 are a source line start pulse SSP and a source line clock signal SCLK. Note that the source line clock signal SCLK includes a plurality of source line clock signals obtained by phase shift.

The digital/analog converter circuit 107 included in the source line driver circuit 105 is supplied with a data signal Data input from the outside, and a polarity inversion signal POL input from the display control signal generator circuit 101. The digital/analog converter circuit 107 converts the data signal Data into an analog video signal on the basis of the polarity inversion signal POL. Conversion of the data signal into an analog video signal is performed with a circuit including a combination of a ladder resistor and a switch, and γ correction or the like is favorably performed at the same time.

Note that the digital/analog converter circuit 107 included in the source line driver circuit 105 can be another circuit as long as it can switch the polarity of a video signal to be output to a pixel in accordance with the inputted polarity inversion signal POL. For example, it is possible to use an inverting amplifier that switches the polarity of a video signal to be output to a pixel in accordance with the polarity inversion signal POL.

The data signal Data input from the outside is digital data. If the data signal Data is analog data, it is converted into digital data.

The polarity inversion signal POL is used when the data signal Data is converted into an analog video signal (Vdata), and switches the video signal to a high potential (positive polarity) or a low potential (negative polarity) with respect to the common potential.

The video signal Vdata is a voltage based on the data signal Data. The video signal Vdata is a voltage applied to one of the electrodes of the liquid crystal element in each pixel 108 through the source line 110. Application of the video signal to the liquid crystal element is referred to as writing of the video signal into the pixel 108. When the video signals Vdata have different polarities and the absolute value of the difference between the potential of each video signal and the common potential is the same, the values of the data signals Data input to the liquid crystal display device are the same. Note that when the potential of the video signal is higher than the common potential, the positive voltage is applied to the liquid crystal element. On the other hand, when the potential of the video signal is lower than the common potential, the negative voltage is applied to the liquid crystal element.

Note that when the voltage level of a video signal written into a pixel is changed to a corrected voltage level, the response speed of the liquid crystal element can be increased. For example, when the voltage level of a video signal is corrected to a higher level, the response time of the liquid crystal element can be shortened and thus images can be quickly displayed. A driving method in which such a correction signal is added is referred to as overdriving.

In order to invert the outputted polarity inversion signal POL every m frame periods in the display control signal generator circuit 101, for example, the frequency of the vertical synchronization signal (Vsync), which is the synchronization signal, is counted for in cycles to invert the polarity inversion signal POL. Specifically, a counter circuit that counts the frequency of the vertical synchronization signal and outputs the counted value to the display control signal generator circuit 101 may be provided. The counter circuit resets the counted value of the vertical synchronization signal every m cycles, and the display control signal generator circuit 101 switches an H-level potential and an L-level potential of the polarity inversion signal POL in response to the reset.

In order to set the liquid crystal display device 100 in a non-display state, the display control signal generator circuit 101 outputs a polarity inversion signal RPOL in accordance with a stop signal (STP) input from the outside. Here, when the stop signal STP is input to the display control signal generator circuit 101, output of the polarity inversion signal POL is stopped and the polarity inversion signal RPOL is output instead.

The selector circuit 102 selects the data signal Data or a reset data signal Rdata in accordance with the stop signal STP and outputs the selected signal to the digital/analog converter circuit 107. The selector circuit 102 outputs the data signal Data when the stop signal S'I'P is not input thereto, and outputs the reset data signal Rdata when the stop signal STP is input thereto. Here, the reset data signal Rdata is digital data like the data signal Data.

The reset data signal Rdata output to the digital/analog converter circuit 107 is converted into an analog reset signal (Vres) in accordance with the polarity inversion signal RPOL. In other words, the polarity inversion signal RPOL is used when the reset data signal Rdata is converted into the analog reset signal Vres, and switches the reset signal to a high potential (positive polarity) or a low potential (negative polarity) with respect to the common potential.

At the time of displaying an image, the polarity inversion signal POL is output from the display control signal generator circuit 101 in response to the vertical synchronization signal (Vsync), and the data signal Data output from the selector circuit 102 is changed to the video signal Vdata by the digital/analog converter circuit 107 in response to the polarity inversion signal POL. On the other hand, to set the liquid crystal display device in a non-display state, the polarity inversion signal RPOL is output from the display control signal generator circuit 101 in response to the stop signal STP, and the reset data signal Rdata output from the selector circuit 102 is changed to the reset signal Vres by the digital/analog converter circuit 107 in response to the polarity inversion signal RPOL.

Figure 3A:
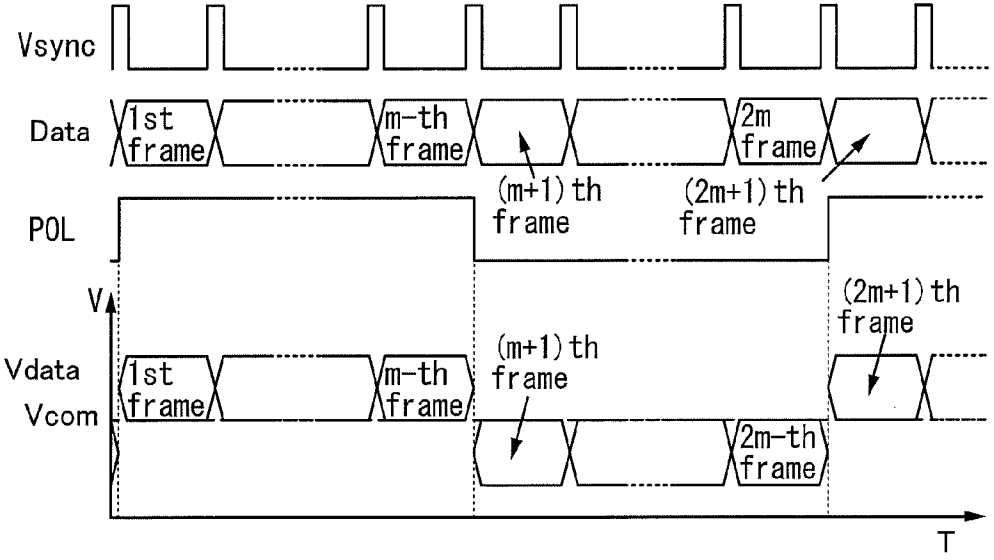
FIGS. 3A and 3B are timing charts showing operation of a liquid crystal display device in one embodiment of the disclosed invention.

FIG. 3A is a timing chart that schematically shows signals input to and output from the display control signal generator circuit 101, the selector circuit 102, and the display panel 103 when the liquid crystal display device 100 displays an image.

The timing chart in FIG. 3A schematically shows the waveforms of the vertical synchronization signal (Vsync), the data signal (Data), and the polarity inversion signal POL. In the timing chart in FIG. 3A, the horizontal axis represents time and the vertical axis represents the voltage level of the video signal Vdata applied to a liquid crystal element in a pixel.

In the timing chart in FIG. 3A, the data signal is continuously supplied from a first frame to an m-th frame (m is a natural number of 2 or more) in synchronization with the cycle of H-levels of the vertical synchronization signal. The polarity inversion signal POL is inverted every time the count of H-levels of the vertical synchronization signal reaches m. Thus, the polarity inversion signal POL can be a signal that is inverted every m frames.

The video signal that is inverted to positive or negative polarity in accordance with inversion of the polarity inversion signal POL is written into each pixel as the voltage level relative to the common potential. With the structure in this embodiment, operation in which the inversion state with one polarity is continuously maintained in a period of m frames can be performed as shown in FIG. 3A.

A display device using a liquid crystal element as a display element generally performs inversion driving in which positive polarity and negative polarity are alternately applied to the display element every frame period, such as gate line inversion driving, source line inversion driving, frame inversion driving, or dot inversion driving. If inversion driving is performed when the voltage level of the video signal applied to the liquid crystal element is high, the amount of change in video signal becomes large because of signal inversion even though the voltage level applied to the display element is not changed; thus, power consumption is increased. The increase in power consumption is significant particularly in driving with high drive frequency.

In contrast, in the example shown in FIG. 3A, data can be written with application of the video signals with the same polarity in a period of m frames or more continuously. Accordingly, the problem, in which the amount of change in video signal due to inversion driving is large when inversion driving is performed every frame period, can be reduced, leading to the reduction in power consumption.

Since inversion driving is performed every m frame periods as shown in FIG. 3A in the structure of this embodiment, the amount of change in video signal is large between the m-th frame and an (m+1)th frame and between a 2m-th frame and a (2m+1)th frame. As a measure against this, a blank period during which the potential of the video signal is set at approximately the same potential as the common potential Vcom is provided between the m-th frame and the (m+1)th frame and between the 2m-th frame and the (2m+1)th frame, whereby the amount of change in video signals can be reduced, enabling a further reduction in power consumption.

Figure 3B:
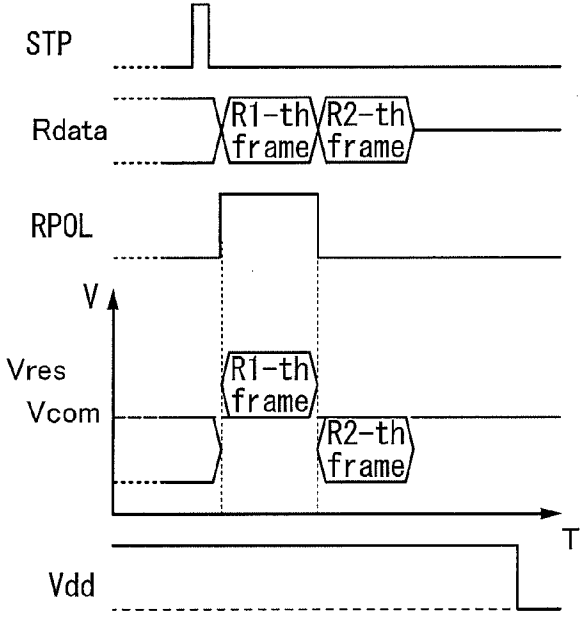

FIG. 3B is a timing chart that schematically shows signals input to and output from the display control signal generator circuit 101, the selector circuit 102, and the display panel 103 when the liquid crystal display device 100 is set in an image non-display state.

The timing chart in FIG. 3B schematically shows the waveforms of the stop signal (STP), the reset data signal (Rdata), and the polarity inversion signal RPOL. In the timing chart in FIG. 3B, the horizontal axis represents time and the vertical axis represents the voltage level of the reset signal Vres applied to a liquid crystal element in a pixel.

In the timing chart in FIG. 3B, when the H-level stop signal STP is input, the reset data signal is input in an R1-th frame and an R2-th frame. Here, the R1-th frame and the R2-th frame refer to the first frame and the second frame, respectively, after the stop signal STP is input. The polarity inversion signal RPOL is inverted in the R1-th frame and the R2-th frame; in FIG. 3B, the polarity inversion signal RPOL is positive in the R1-th frame and is negative in the R2-th frame.

The reset signal Vres that is inverted to positive or negative polarity in accordance with the polarity inversion signal RPOL is written into each pixel as the voltage level with respect to the common potential Vcom. In FIG. 3B, the reset signal Vres is positive in the R1-th frame and is negative in the R2-th frame. At this time, it is preferable that the absolute value of the voltage level be as large as possible, for example, be approximately the same as the maximum absolute value of the voltage level of the video signal. Moreover, the polarity of the reset signal Vres in the R1-th frame is preferably opposite to that of the video signal Vdata at the time when the stop signal STP is input. After the reset signal Vres is input to all the pixels in this manner, supply of the high power supply potential VDD is interrupted.

By inputting the reset signal Vres in such a manner, deterioration of liquid crystal can be suppressed even when video signals with the same polarity are continuously written for an in-frame period or longer as described above. Thus, it is possible to provide a liquid crystal display device in which deterioration of liquid crystal is small while low power consumption is achieved even in moving image display.

Without limitation to FIG. 3B (in which a positive potential and a negative potential are applied as the reset signal in two frames of the R1-th frame and the R2-th frame, respectively), the reset signal may be input while the polarity of the potential is inverted in three or more frames. Moreover, the reset signal with a potential having polarity opposite to that of the potential of the video signal Vdata at the time when the stop signal STP is input can be input only in one frame.

The R1-th frame and the R2-th frame in FIG. 3B are the same in length as one frame period shown in FIG. 3A; however, the liquid crystal display device described in this embodiment is not limited to this, and the length of the R1-th frame, the R2-th frame, an R3-th frame, and/or a later period may be larger than that of one frame period.

After a potential that is inverted in polarity at least one time is input as the reset signal Vres in the above manner, the potential of the reset signal Vres is preferably set at approximately the same potential as the common potential Vcom. For example, in FIG. 3B, the R3-th frame during which the voltage level of the reset signal becomes the common potential Vcom may be provided after the R2-th frame. Further, after the potential difference between electrodes of the liquid crystal element is made approximately 0 V in this manner, it is preferable to turn off a transistor that is provided in a pixel and electrically connected to the liquid crystal element.

Next, a specific structure example of the display panel 103 illustrated in FIG. 2 will be shown, and the effect of this embodiment will be described in detail.

Figure 4:
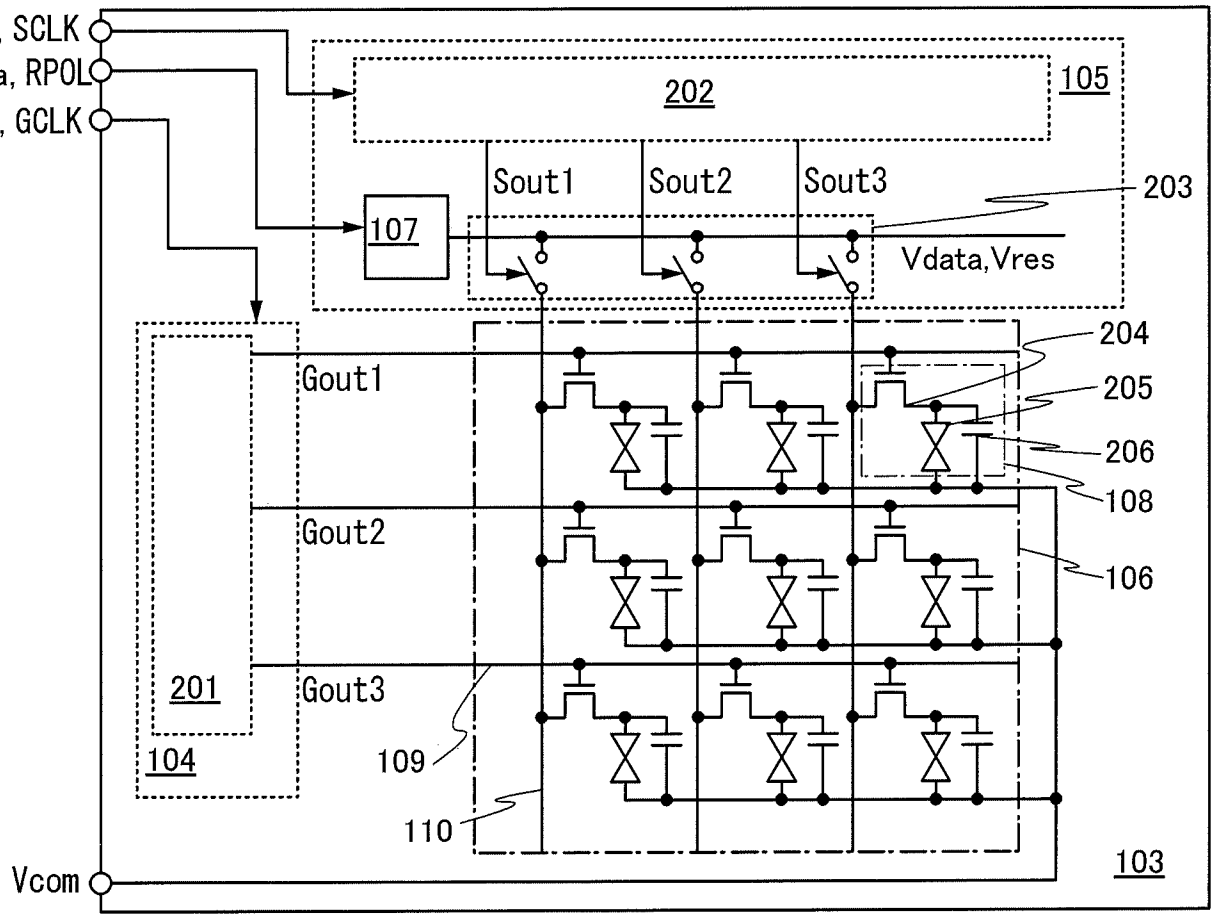
FIG. 4 is a block diagram illustrating a liquid crystal display device in one embodiment of the disclosed invention.

FIG. 4 specifically illustrates the structures of the gate line driver circuit 104, the source line driver circuit 105, and the pixel portion 106 included in the display panel 103 in FIG. 2.

The gate line driver circuit 104 includes a shift register circuit 201. The source line driver circuit 105 includes a shift register circuit 202, the digital/analog converter circuit 107, and an analog switch 203.

FIG. 4 shows an example where the pixel portion 106 includes pixels 108 arranged in three rows and three columns. Each of the pixels 108 includes a transistor 204, a capacitor 205, and a liquid crystal element 206. A gate of the transistor 204 is connected to the gate line 109. One of a source and a drain of the transistor 204 is connected to the source line 110.

As the transistor 204, a transistor with low current in the off state (off-state current), for example, a transistor including an oxide semiconductor is preferably used. The use of such a transistor as the transistor 204 prevents charge from leaking from the capacitor 205 and the liquid crystal element 206 through the transistor 204, so that the voltage applied to the liquid crystal element 206 can be held for a long time. Thus, characteristics of holding display images of the liquid crystal display device 100 can be improved.

On the other hand, when a transistor with low off-state current is used as the transistor 204, the voltage of the liquid crystal element 206, which is connected to the transistor 204, may be held even after the liquid crystal display device 100 is powered off, and as a result, an electric field of the same polarity may be applied to liquid crystal for a long time so that the liquid crystal might deteriorate. To deal with this problem, as described above, a potential that is inverted in polarity at least one time is input as the reset signal and then the potential of the reset signal Vres is set at approximately the same potential as the common potential Vcom to turn off the transistor 204, thereby preventing an electric field of the same polarity applied to liquid crystal for a long time.

As described above, it is preferable that during power off of the liquid crystal display device 100, the liquid crystal display device 100 be activated at a time set by a timer and then the reset signal be input. Thus, even if the voltage of the liquid crystal element 206 is held when the liquid crystal display device 100 is powered off, liquid crystal can be brought into a state without application of an electric field at the time set by the timer.

In FIG. 4, the gate line start pulse GSP and the gate line clock signal GCLK are input to the shift register circuit 201 included in the gate line driver circuit 104. The shift register circuit 201 can sequentially output H-level signals as selection signals Gout1 to Gout 3 to the gate lines 109 in the first to third rows to control the on/off states of the transistors 204.

In FIG. 4, when an image is displayed, the digital/analog converter circuit 107 included in the source line driver circuit 105 outputs the video signal Vdata, which is generated in accordance with the data signal Data and the polarity inversion signal POL. When the display panel is set in a non-display state, the digital/analog converter circuit 107 outputs the reset signal Vres, which is generated in accordance with the reset data signal Rdata and the polarity inversion signal RPOL. The video signal Vdata and the reset signal Vres are written into the capacitor 205 and the liquid crystal element 206 in the pixel 108 through the source line 110 when the analog switch 203 is turned on.

In FIG. 4, the source line start pulse SSP and the source line clock signal SCLK are input to the shift register circuit 202 included in the source line driver circuit 105. The shift register circuit 202 can sequentially output H-level signals as selection signals Sout1 to Sout 3 to the analog switches 203 in the first to third columns to control the on/off states of the analog switches 203.

Figure 5A:
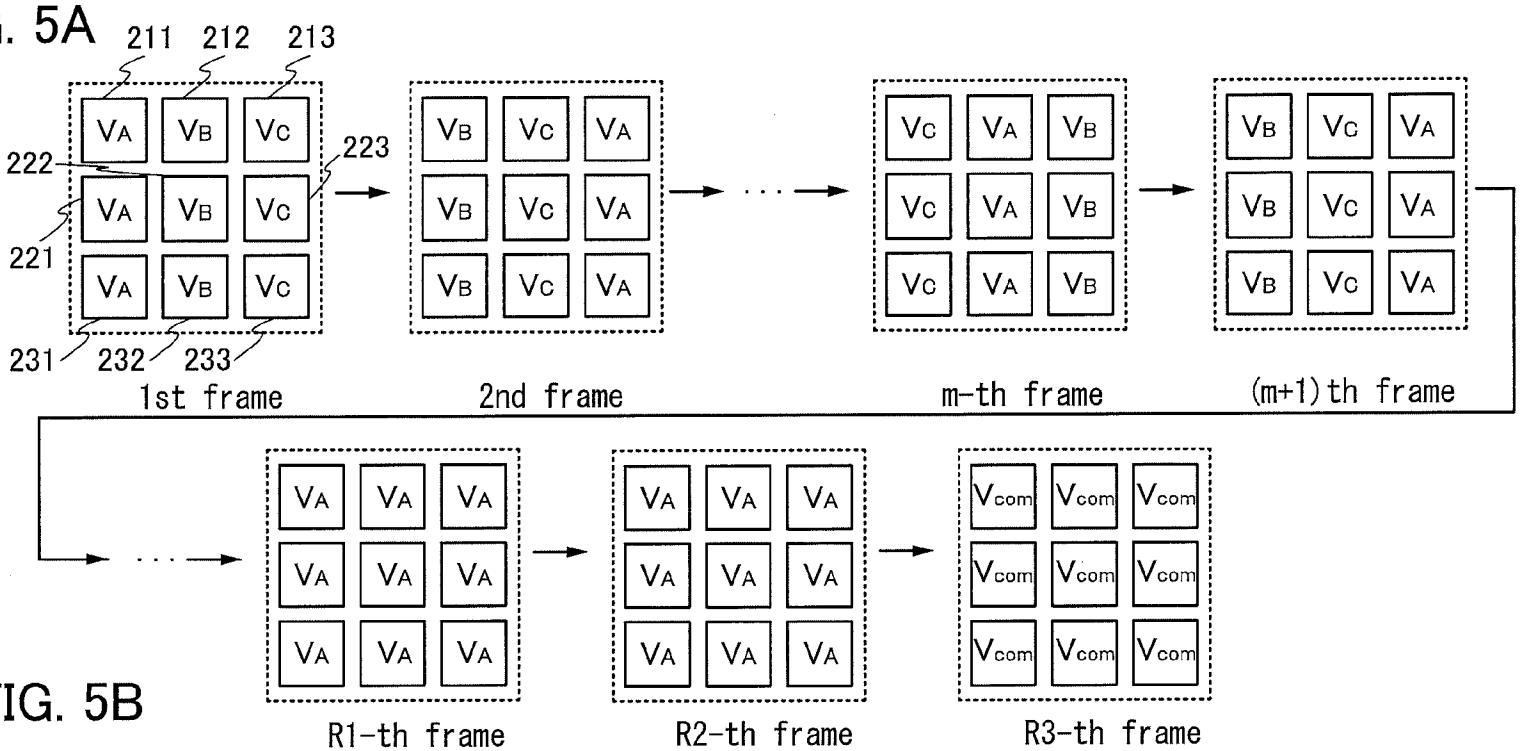
FIGS. 5A and 5B are schematic diagrams for explaining operation of a liquid crystal display device in one embodiment of the disclosed invention.
Figure 5B:
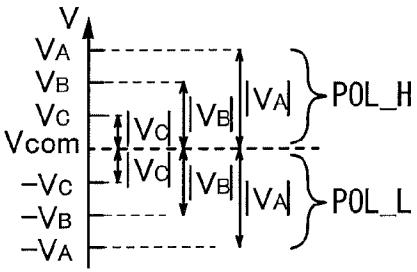

Next, an example of specific operation with a driving method of the present invention in a plurality of frame periods will be described with reference to FIGS. 5A and 5B. FIG. 5A is a schematic diagram of a pixel portion, and FIG. 5B shows video signals with positive or negative polarity based on data signals.

FIG. 5A is a schematic diagram of data signals input to a pixel portion including pixels arranged in a matrix of three rows and three columns in the first frame, the second frame, the m-th frame, and the (m+1)th frame in an image display state and the R1-th frame, the R2-th frame, and the R3-th frame in an image non-display state. Here, the R1-th frame, the R2-th frame, and the R3-th frame refer to the first frame, the second frame, and the third frame, respectively, after the stop signal STP is input.

FIG. 5A shows an example where as data signals, "$V_A$" is input to a pixel 211 in the first row and the first column, a pixel 221 in the second row and the first column, and a pixel 231 in the third row and the first column; "$V_B$" is input to a pixel 212 in the first row and the second column, a pixel 222 in the second row and the second column, and a pixel 232 in the third row and the second column; and "$V_C$" is input to a pixel 213 in the first row and the third column, a pixel 223 in the second row and the third column, and a pixel 233 in the third row and the third column.

When the data signals $V_A$, $V_B$ and $V_C$ shown in FIG. 5A are regarded as the voltage levels of the video signals, they can be represented by $|V_A|$, $|V_B|$, and $|V_C|$. For convenience of description, an example of the magnitude relation of $|V_A|$, $|V_A|$, and $|V_C|$ is $|V_C|<|V_B|<|V_A|$. When the polarity inversion signal POL is at H level (POL_H), the video signals can be represented by "$V_A$", "$V_B$", and "$V_C$" as shown in FIG. 5B and positive video signals are written. When the polarity inversion signal POL is at L level ($POL_{13}$ L), the video signals can be represented by "$-V_A$", "$-V_B$", and "$-V_C$" as shown in FIG. 5B and negative video signals are written. Note that as shown in FIG. 5B, the video signals $V_A$, $V_B$ and $V_C$ are the same in level as the video signals $-V_A$, $-V_B$ and $-V_C$, respectively, and these signals are symmetric about the common potential Vcom.

In FIG. 5A, in the second frame, as the data signals, $V_B$ is input to the pixels 211, 221, and 231; $V_C$ is input to the pixels 212, 222, and 232; and $V_A$ is input to the pixels 213, 223, and 233.

In FIG. 5A, in the m-th frame, as the data signals, $V_C$ is input to the pixels 211, 221, and 231; $V_A$ is input to the pixels 212, 222, and 232; and $V_B$ is input to the pixels 213, 223, and 233.

In FIG. 5A, in the (m+1)th frame, as the data signals, $V_B$ is input to the pixels 211, 221, and 231; $V_C$ is input to the pixels 212, 222, and 232; and $V_A$ is input to the pixels 213, 223, and 233.

In FIG. 5A, $V_A$ is input as the data signal to all the pixels in the R1-th frame and the R2-th frame. Moreover, in FIG. 5A, "$V_{com}$" that corresponds to the common potential Vcom is input as the data signal to all the pixels in the R3-th frame.

Figure 6:
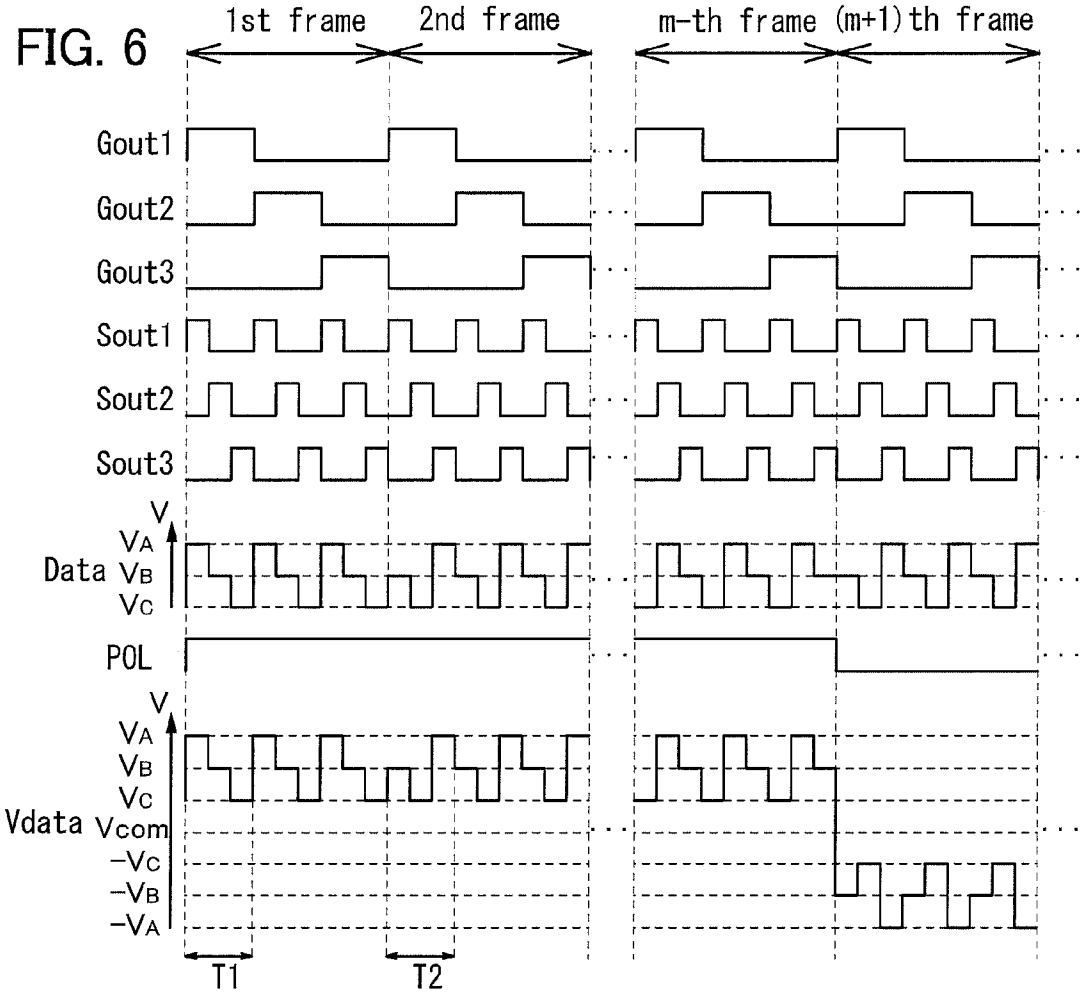
FIG. 6 is a timing chart showing operation of a liquid crystal display device in one embodiment of the disclosed invention.

FIG. 6 is a timing chart showing input of data signals to the pixel portion during image display illustrated in FIG. 5A. The timing chart in FIG. 6 shows the selection signals Gout1 to Gout 3, the selection signals Sout1 to Sout3, the data signal Data, the polarity inversion signal POL, and the video signal Vdata in the first frame, the second frame, the m-th frame, and the (m+1)th frame. Although the case of employing dot sequential driving is described here using the timing chart in FIG. 6, line sequential driving may be employed.

In the timing chart in FIG. 6, the polarity inversion signal POL can be inverted every m frame periods as described with reference to FIG. 3A. Accordingly, the video signal Vdata in this embodiment can serve as a video signal with the same polarity in a period of n7 frames continuously. Accordingly, the problem in which the amount of change in video signals due to inversion driving is large when inversion driving is performed every frame period can be reduced, leading to the reduction in power consumption.

Figure 7A:
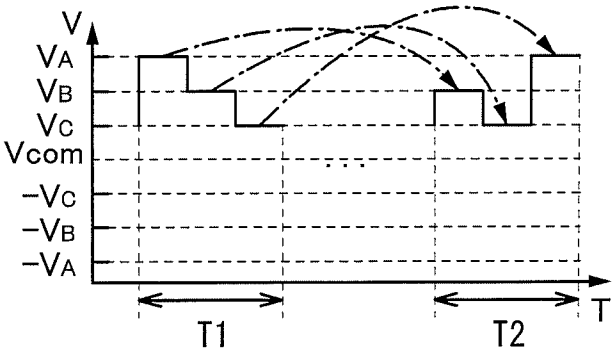
FIGS. 7A and 7B are timing charts showing operation of a liquid crystal display device in one embodiment of the disclosed invention.
Figure 7B:
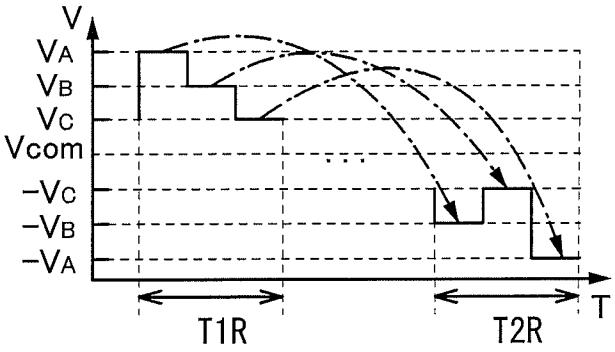

A change in the video signal in the first column of the pixel portion is extracted from the timing chart of FIG. 6 and shown in FIGS. 7A and 7B.

FIG. 7A is a schematic diagram showing a change in the video signal between a period T1 and a period T2 in FIG. 6. FIG. 7B is a schematic diagram showing a change in the video signal in a period T1R and a period T2R that correspond to the period T1 and the period T2 in FIG. 6, in the case where the polarity inversion signal POL is inverted every frame in the timing chart of FIG. 6. That is, the polarity of the video signal is inverted between the period T1 and the period T2 in FIG. 7B.

The period T1 in FIG. 7A represents the video signal in the first row and each column in the first frame. The period T2 in FIG. 7A represents the video signal in the first row and each column in the second frame. The period T1R in FIG. 7B represents the video signal in the first row and each column in the first frame. The period T2R in FIG. 7B represents the video signal in the second row and each column in the second frame. Note that in FIGS. 7A and 7B, attention is focused on the video signals in the same column in the periods T1 and T2 and in the periods T1R and T2R, and a change in the video signal between these periods is indicated by arrows.

In FIG. 7A, the difference in the video signal between the first frame and the second frame in one row and each column is $|V_A-V_B|$ in the first column, $|V_B-V_C|$ in the second column, and $|V_C-V_A|$ in the third column. In FIG. 7B, the difference in the video signal between the first frame and the second frame in one row and each column is $|V_A+V_B|$ in the first column, $|V_B+V_C|$ in the second column, and $|V_C+V_A|$ in the third column.

When attention is focused on the video signals in the same column in FIGS. 7A and 7B, the voltage changes more significantly with frame inversion driving shown in FIG. 7B in which the polarity inversion signal POL is inverted every frame. On the other hand, when the polarity inversion signal POL is inverted every m frame periods as shown in FIG. 7A, a change in the video signal in the same column is small. Thus, with the driving shown in FIG. 7A, power consumed for charging and discharging the video signals written into pixels can be reduced.

Consequently, it is possible to provide a liquid crystal display device that consumes less power even while displaying moving images.

Figure 8:
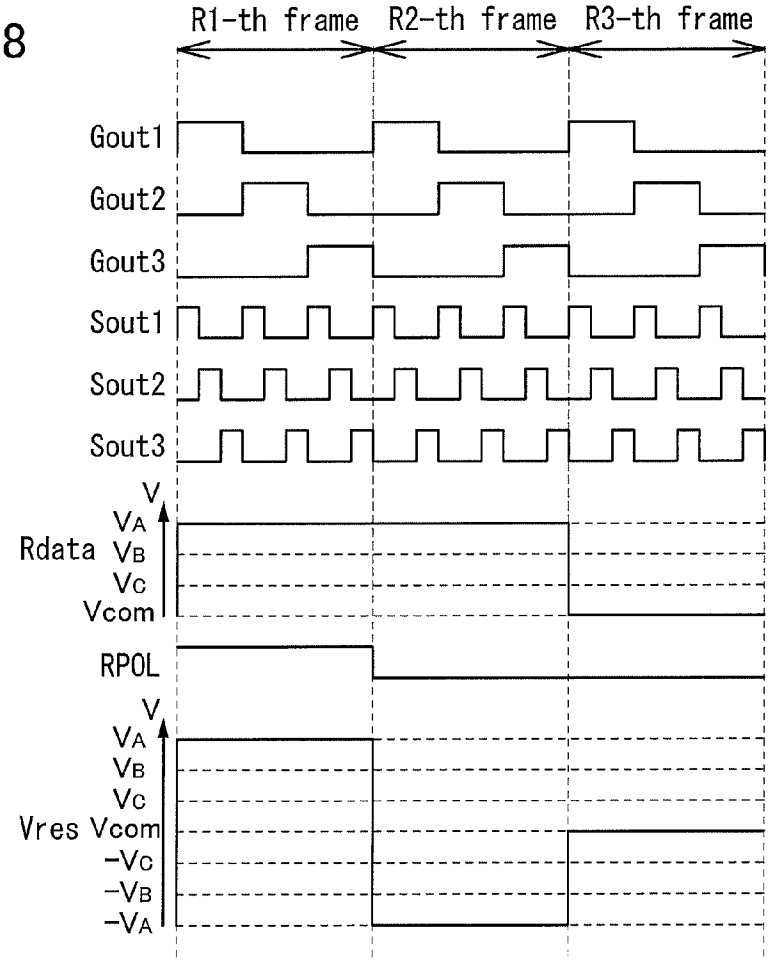
FIG. 8 is a timing chart showing operation of a liquid crystal display device in one embodiment of the disclosed invention.

FIG. 8 is a timing chart showing data signals input to the pixel portion when the liquid crystal display device is set in a non-display state as illustrated in FIG. 5A. The timing chart in FIG. 8 shows the selection signals Gout1 to Gout 3, the selection signals Sout1 to Sout3, the reset data signal Rdata, the polarity inversion signal RPOL, and the reset signal Vres in the R1-th frame, the R2-th frame, and the R3-th frame.

Although the case of employing dot sequential driving is described using the timing chart in FIG. 8, line sequential driving may be employed.

In the timing chart in FIG. 8, the potential of the polarity inversion signal RPOL is inverted between the R1-th frame and the R2-th frame as described with reference to FIG. 3B. Thus, as the reset signal Vres, the potential $V_A$ is input in the R1-th frame and the potential $-V_A$ is input in the R2-th frame. By inputting the reset signal Vres in such a manner, deterioration of liquid crystal can be suppressed even when video signals with the same polarity are continuously written for an m-frame period or longer as shown in FIG. 6. Moreover, when the potential of the reset signal Vres is made approximately the same as the maximum absolute value of the voltage level of the video signal Vdata in this manner, an inverted high electric field can be applied to the liquid crystal element; thus, deterioration of the liquid crystal element can be further suppressed.

In the R3-th frame, the common potential Vcom that corresponds to the data signal $V_{com}$ is input as the reset signal Vres. After the potential difference between the electrodes of the liquid crystal element is made approximately 0 V in this manner, the transistor 204, which is provided in the pixel and electrically connected to the liquid crystal element 206, is turned off, thereby preventing an electric field with fixed polarity from being applied to liquid crystal for a long time.

As described above, it is possible to provide a liquid crystal display device in which power consumption is low even in moving image display and deterioration of liquid crystal elements is small.

In this embodiment, a liquid crystal display device in which frame inversion driving is performed is described as an example; however, a liquid crystal display device may have another structure, and for example, may employ gate line inversion driving, source line inversion driving, or dot inversion driving.

The structures, methods, and the like described in this embodiment can be combined as appropriate with any of the structures, methods, and the like described in the other embodiments.

(Embodiment 2)

This embodiment will show the appearance and a cross section of a display device to explain a structure thereof. In this embodiment, examples of using a liquid crystal element as a display element will be described.

A liquid crystal display device includes any of the following modules in its category: a module to which a connector such as a flexible printed circuit (FPC) or a tape carrier package (TCP) is attached; a module having a TCP at the tip of which a printed wiring board is provided; and a module in which an integrated circuit (IC) is directly mounted on a display element by chip on glass (COG).

Figure 9B:
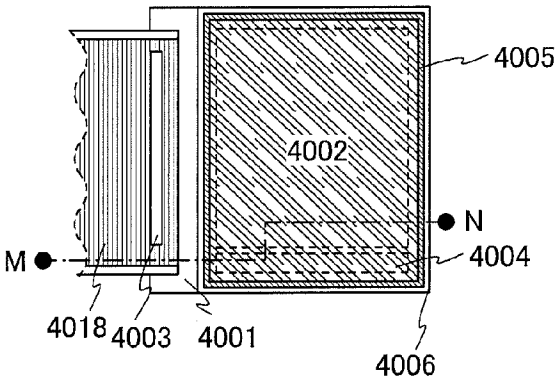
Figure 9B:
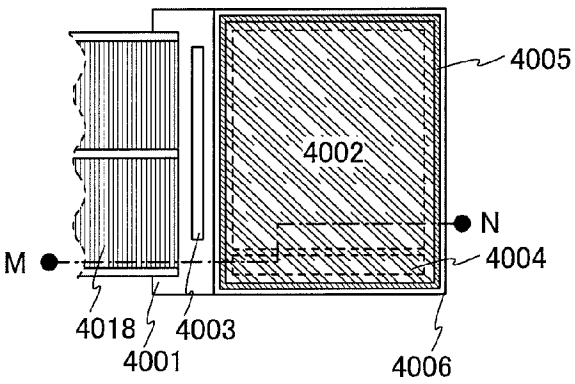
Figure 9B:
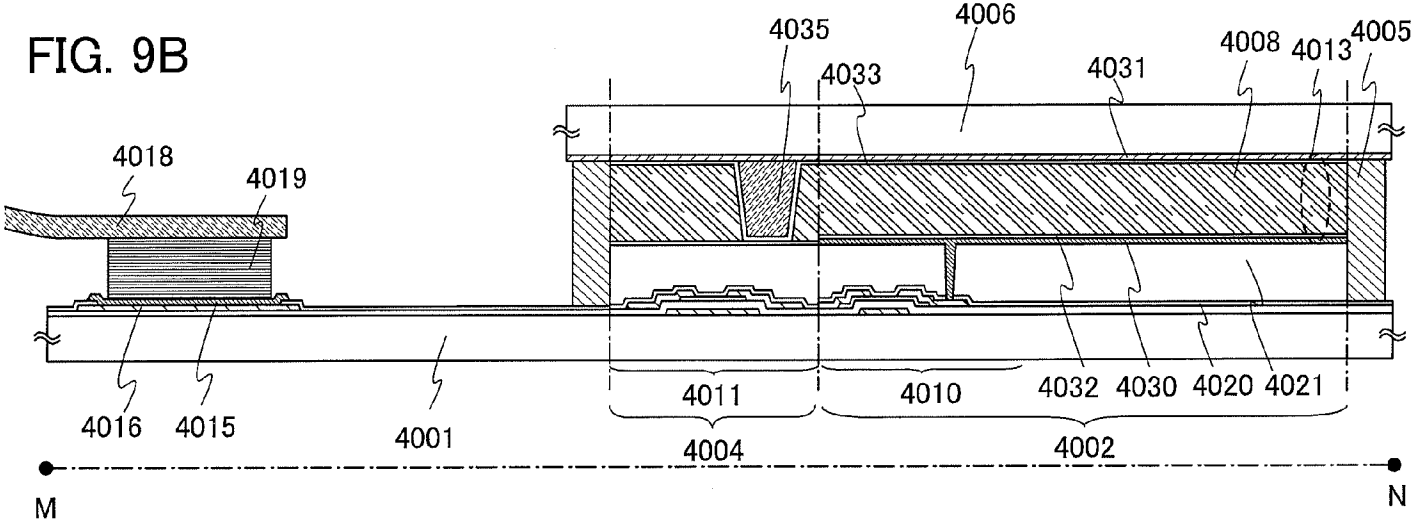

The appearance and a cross section of a liquid crystal display device will be described with reference to FIGS. 9A1, 9A2, and 9B. FIGS. 9A1 and 9A2 are each a plan view of a panel in which transistors 4010 and 4011 and a liquid crystal element 4013 are sealed between a first substrate 4001 and a second substrate 4006 with a sealant 4005. FIG. 9B is a cross-sectional view along line M-N in FIGS. 9A1 and 9A2.

The sealant 4005 is provided to surround a pixel portion 4002 and a gate line driver circuit 4004 that are provided over the first substrate 4001. The second substrate 4006 is provided over the pixel portion 4002 and the gate line driver circuit 4004. Thus, the pixel portion 4002 and the gate line driver circuit 4004 are sealed together with a liquid crystal layer 4008, by the first substrate 4001, the sealant 4005, and the second substrate 4006. A source line driver circuit 4003 that is formed using a single crystal semiconductor film or a polycrystalline semiconductor film over a substrate separately prepared is mounted in a region that is different from the region surrounded by the sealant 4005 over the first substrate 4001.

Although not illustrated in FIGS. 9A1, 9A2, and 9B, a backlight that emits light to pixels can be provided as appropriate as a light source. Here, it is preferable that the backlight do not emit light during input of the reset signal, in which case disturbance of images due to input of the reset signal can be prevented from being displayed. In addition, although not illustrated in FIGS. 9A1, 9A2, and 9B, a timer for activating the liquid crystal display device at a set time can be provided as appropriate. Here, the timer can make the liquid crystal display device activated at a specific time in which the liquid crystal display device is not in use (e.g., at a time in which a user does not usually use the liquid crystal display device, for example, at midnight), and then the reset signal is input. An optical film such as a retardation plate or an anti-reflection film can be provided as appropriate. Moreover, a coloring layer functioning as a color filter layer can be provided.

There is no particular limitation on the connection method of the driver circuit that is separately formed, and a COG method, a wire bonding method, a TAB method, or the like can be used. FIG. 9A1 illustrates an example where the source line driver circuit 4003 is mounted by a COG method, and FIG. 9A2 illustrates an example where the source line driver circuit 4003 is mounted by a TAB method.

Each of the pixel portion 4002 and the scan line driver circuit 4004 provided over the first substrate 4001 includes a plurality of transistors. FIG. 9B illustrates the transistor 4010 included in the pixel portion 4002 and the transistor 4011 included in the scan-line driver circuit 4004 as an example. Insulating layers 4020 and 4021 are provided over the transistors 4010 and 4011.

The transistors 4010 and 4011 can use a semiconductor thin film of silicon, germanium, or the like in an amorphous, microcrystalline, polycrystalline, or signal crystal state as a semiconductor layer. Alternatively, the transistors 4010 and 4011 can use an oxide semiconductor for the semiconductor layer. In this embodiment, the transistors 4010 and 4011 are n-channel transistors. With the use of an oxide semiconductor for the semiconductor layer, a transistor with extremely low off-state current can be used as a switching element in a pixel. In this case, a change in the video signal that has been written into the pixel is small, resulting in higher display quality.

Here, a highly purified oxide semiconductor (purified OS) obtained by reduction of impurities such as moisture or hydrogen serving as an electron donor (donor) and by reduction of oxygen vacancies is an intrinsic (i-type) semiconductor or a substantially i-type semiconductor. For this reason, a transistor including a semiconductor layer containing a highly purified oxide semiconductor has extremely low off-state current and high reliability.

Specifically, various experiments can prove a low off-state current of a transistor having a channel formation region in a highly purified oxide semiconductor film. For example, the off-state current of even an element having a channel width of $1\times10^6$ μm and a channel length of 10 μm can be less than or equal to the measurement limit of a semiconductor parameter analyzer, that is, less than or equal to $1\times10^{-13}$ A at a voltage between the source electrode and the drain electrode (a drain voltage) of 1 V to 10 V. In this case, it can be seen that off-state current standardized on the channel width of the transistor is lower than or equal to 100 zA/μm. In addition, the off-state current is measured using a circuit in which a capacitor and a transistor are connected to each other and charge flowing into or from the capacitor is controlled by the transistor. In the measurement, a highly purified oxide semiconductor film is used for a channel formation region of the transistor, and the off-state current of the transistor is measured from a change in the amount of charge of the capacitor per unit time. As a result, it is found that when the voltage between the source electrode and the drain electrode of the transistor is 3 V, a lower off-state current of several tens of yoctoamperes per micrometer (yA/μm) is obtained. Consequently, the transistor in which a highly purified oxide semiconductor film is used for a channel formation region has much lower off-state current than a transistor including crystalline silicon.

When an oxide semiconductor film is used as the semiconductor layer of the transistors 4010 and 4011, the oxide semiconductor preferably contains at least indium (In) or zinc (Zn). Further, as a stabilizer for reducing variations in electric characteristics of transistors using the oxide semiconductor, the oxide semiconductor preferably contains gallium (Ga), tin (Sn), hafnium (Hf), aluminum (Al), and/or zirconium (Zr) in addition to indium (In) and/or zinc (Zn).

In—Ga—Zn-based oxide and In—Sn—Zn-based oxide among oxide semiconductors have the following advantages over silicon carbide, gallium nitride, and gallium oxide: transistors with excellent electrical characteristics can be formed by sputtering or a wet process and thus can be mass-produced easily. Further, unlike in the case of using silicon carbide, gallium nitride, or gallium oxide, with the use of the In—Ga—Zn-based oxide, transistors with excellent electrical characteristics can be formed over a glass substrate, and a larger substrate can be used.

As another stabilizer, the oxide semiconductor may contain one or plural kinds of lanthanoid such as lanthanum (La), cerium (Ce), praseodymium (Pr), neodymium (Nd), samarium (Sm), europium (Eu), gadolinium (Gd), terbium (Tb), dysprosium (Dy), holmium (Ho), erbium (Er), thulium (Tm), ytterbium (Yb), and lutetium (Lu).

As the oxide semiconductor, any of the following oxides can be used, for example: indium oxide, gallium oxide, tin oxide, zinc oxide, a two-component metal oxide such as In—Zn-based oxide, Sn—Zn-based oxide, Al—Zn-based oxide, Zn—Mg-based oxide, Sn—Mg-based oxide, In—Mg-based oxide, and In—Ga-based oxide; a three-component metal oxide such as In—Ga—Zn-based oxide (also referred to as IGZO), In—Al—Zn-based oxide, In—Sn—Zn-based oxide, Sn—Ga—Zn-based oxide, Al—Ga—Zn-based oxide, Sn—Al—Zn-based oxide, In—Hf—Zn-based oxide, In—La—Zn-based oxide, In—Pr—Zn-based oxide, In—Nd—Zn-based oxide, In—Sm—Zn-based oxide, In—Eu—Zn-based oxide, In—Gd—Zn-based oxide, In—Tb—Zn-based oxide, In—Dy—Zn-based oxide, In—Ho—Zn-based oxide, In—Er—Zn-based oxide, In—Tm—Zn-based oxide, In—Yb—Zn-based oxide, and In—Lu—Zn-based oxide; and a four-component metal oxide such as In—Sn—Ga—Zn-based oxide, In—Hf—Ga—Zn-based oxide, In—Al—Ga—Zn-based oxide, In—Sn—Al—Zn-based oxide, In—Sn—Hf—Zn-based oxide, and In—Hf—Al—Zn-based oxide.

For example, an In—Ga—Zn-based oxide refers to an oxide containing In, Ga, and Zn, and there is no limitation on the composition ratio of In, Ga, and Zn. Further, the In—Ga—Zn-based oxide may contain a metal element other than In, Ga, and Zn. The In—Ga—Zn-based oxide has sufficiently high resistance when no electric field is applied thereto, so that off-state current can be sufficiently reduced. Moreover, the In—Ga—Zn-based oxide has high mobility.

For example, an In—Ga—Zn-based oxide with an atomic ratio of In:Ga:Zn=1:1:1 (=1/3:1/3:1/3) or In:Ga:Zn=2:2:1 (=2/5:2/5:1/5), or an oxide with an atomic ratio close to the above atomic ratios can be used. Alternatively, an In—Sn—Zn-based oxide with an atomic ratio of In:Sn:Zn=1:1:1 (=1/3:1/3:1/3), In:Sn:Zn=2:1:3 (=1/3:1/6:1/2), or In:Sn:Zn=2:1:5 (=1/4:1/8:5/8) or an oxide with an atomic ratio close to the above atomic ratios may be used.

For example, high mobility can be obtained relatively easily with an In—Sn—Zn-based oxide. However, even with an In—Ga—Zn-based oxide, the mobility can be increased by reduction in the defect density in a bulk.

Note that an oxide semiconductor film in a single crystal state, a polycrystalline (also referred to as polycrystal) state, an amorphous state, or the like can be used in the transistor. The oxide semiconductor film is preferably a c-axis aligned crystalline oxide semiconductor (CAAC-OS) film.

A structure of an oxide semiconductor film is described below.

An oxide semiconductor film is classified roughly into a single-crystal oxide semiconductor film and a non-single-crystal oxide semiconductor film. The non-single-crystal oxide semiconductor film includes any of an amorphous oxide semiconductor film, a microcrystalline oxide semiconductor film, a polycrystalline oxide semiconductor film, a c-axis aligned crystalline oxide semiconductor (CAAC-OS) film, and the like.

The amorphous oxide semiconductor film has disordered atomic arrangement and no crystalline component. A typical example of the amorphous oxide semiconductor film is an oxide semiconductor film in which no crystal part exists even in a microscopic region, and the whole of the film is amorphous.

The microcrystalline oxide semiconductor film includes a microcrystal (also referred to as nanocrystal) with a size greater than or equal to 1 nm and less than 10 nm, for example. Thus, the microcrystalline oxide semiconductor film has a higher degree of atomic order than the amorphous oxide semiconductor film. Hence, the density of defect states of the microcrystalline oxide semiconductor film is lower than that of the amorphous oxide semiconductor film.

The CAAC-OS film is one of oxide semiconductor films including a plurality of crystal parts, and most of the crystal parts each fit inside a cube whose one side is less than 100 nm. Thus, there is a case where a crystal part included in the CAAC-OS film fits inside a cube whose one side is less than 10 nm, less than 5 nm, or less than 3 nm. The density of defect states of the CAAC-OS film is lower than that of the microcrystalline oxide semiconductor film. The CAAC-OS film is described in detail below.

In a transmission electron microscope (TEM) image of the CAAC-OS film, a boundary between crystal parts, that is, a grain boundary is not clearly observed. Thus, in the CAAC-OS film, a reduction in electron mobility due to the grain boundary is less likely to occur.

According to the TEM image of the CAAC-OS film observed in a direction substantially parallel to a sample surface (cross-sectional TEM image), metal atoms are arranged in a layered manner in the crystal parts. Each metal atom layer has a morphology reflected by a surface over which the CAAC-OS film is formed (hereinafter a surface over which the CAAC-OS film is formed is referred to as a formation surface) or a top surface of the CAAC-OS film, and is arranged in parallel to the formation surface or the top surface of the CAAC-OS film.

On the other hand, according to the TEM image of the CAAC-OS film observed in a direction substantially perpendicular to the sample surface (plan TEM image), metal atoms are arranged in a triangular or hexagonal configuration in the crystal parts. However, there is no regularity of arrangement of metal atoms between different crystal parts.

In this specification, the term "parallel" indicates that the angle formed between two straight lines is greater than or equal to −10° and less than or equal to 10°, and accordingly also includes the case where the angle is greater than or equal to −5° and less than or equal to 5°. In addition, the term "perpendicular" indicates that the angle formed between two straight lines is greater than or equal to 80° and less than or equal to 100°, and accordingly includes the case where the angle is greater than or equal to 85° and less than or equal to 95°.

From the results of the cross-sectional TEM image and the plan TEM image, alignment is found in the crystal parts in the CAAC-OS film.

A CAAC-OS film is subjected to structural analysis with an X-ray diffraction (XRD) apparatus. For example, when a CAAC-OS film including an $InGaZnO_4$ crystal is analyzed by an out-of-plane method, a peak appears frequently when the diffraction angle (2θ) is around 31°. This peak is derived from the (009) plane of the $InGaZnO_4$ crystal, which indicates that crystals in the CAAC-OS film have c-axis alignment, and that the c-axes are aligned in a direction substantially perpendicular to the formation surface or the top surface of the CAAC-OS film.

On the other hand, when the CAAC-OS film is analyzed by an in-plane method in which an X-ray enters a sample in a direction substantially perpendicular to the c-axis, a peak appears frequently when 2θ is around 56°. This peak is derived from the (110) plane of the $InGaZnO_4$ crystal. Here, analysis (ϕ scan) is performed under conditions where the sample is rotated around a normal vector of a sample surface as an axis (ϕ axis) with 2θ fixed at around 56°. In the case where the sample is a single-crystal oxide semiconductor film of $InGaZnO_4$, six peaks appear. The six peaks are derived from crystal planes equivalent to the (110) plane. On the other hand, in the case of a CAAC-OS film, a peak is not clearly observed even when ϕ scan is performed with 2θ fixed at around 56°.

According to the above results, in the CAAC-OS film having c-axis alignment, while the directions of a-axes and b-axes are different between crystal parts, the c-axes are aligned in a direction parallel to a normal vector of a formation surface or a normal vector of a top surface. Thus, each metal atom layer arranged in a layered manner observed in the cross-sectional TEM image corresponds to a plane parallel to the a-b plane of the crystal.

Note that the crystal part is formed concurrently with deposition of the CAAC-OS film or is formed through crystallization treatment such as heat treatment. As described above, the c-axis of the crystal is aligned in a direction parallel to a normal vector of a formation surface or a normal vector of a top surface. Thus, for example, in the case where the shape of the CAAC-OS film is changed by etching or the like, the c-axis might not be necessarily parallel to a normal vector of a formation surface or a normal vector of a top surface of the CAAC-OS film.

Further, the degree of crystallinity in the CAAC-OS film is not necessarily uniform. For example, when crystal growth leading to the CAAC-OS film occurs from the vicinity of the top surface of the film, the degree of the crystallinity in the vicinity of the top surface is higher than that in the vicinity of the formation surface in some cases. Further, when an impurity is added to the CAAC-OS film, the crystallinity in a region to which the impurity is added is changed, and the degree of crystallinity in the CAAC-OS film varies depending on regions.

Note that when the CAAC-OS film with an $InGaZnO_4$ crystal is analyzed by an out-of-plane method, a peak of 2θ may also be observed at around 36°, in addition to the peak of 2θ at around 31°. The peak of 2θ at around 36° indicates that a crystal having no c-axis alignment is included in part of the CAAC-OS film. It is preferable that in the CAAC-OS film, a peak of 2θ appear at around 31° and a peak of 2θ do not appear at around 36°.

In a transistor using the CAAC-OS film, change in electric characteristics due to irradiation with visible light or ultraviolet light is small. Thus, the transistor has high reliability.

Note that an oxide semiconductor film may be a stacked film including two or more films of an amorphous oxide semiconductor film, a microcrystalline oxide semiconductor film, and a CAAC-OS film, for example.

A pixel electrode layer 4030 included in the liquid crystal element 4013 is connected to the transistor 4010. A counter electrode layer 4031 of the liquid crystal element 4013 is formed on the second substrate 4006. A portion where the pixel electrode layer 4030, the counter electrode layer 4031, and the liquid crystal layer 4008 overlap with one another corresponds to the liquid crystal element 4013. Note that the pixel electrode layer 4030 and the counter electrode layer 4031 are provided with an insulating layer 4032 and an insulating layer 4033 serving as alignment films, respectively, and the liquid crystal layer 4008 is sandwiched between the pixel electrode layer 4030 and the counter electrode layer 4031 with the insulating layers 4032 and 4033 placed therebetween.

A light-transmitting substrate can be used as the first substrate 4001 and the second substrate 4006; glass, ceramics, or plastics can be used. As plastics, a fiberglass-reinforced plastic (FRP) plate, a polyvinyl fluoride (PVF) film, a polyester film, or an acrylic resin film can be used.

A structure 4035 is a columnar spacer obtained by selective etching of an insulating film and is provided in order to control the distance (a cell gap) between the pixel electrode layer 4030 and the counter electrode layer 4031. Alternatively, a spherical spacer may be used. The counter electrode layer 4031 is connected to a common potential line formed over the substrate where the transistor 4010 is formed. With the use of a common contact portion, the counter electrode layer 4031 and the common potential line can be connected to each other by conductive particles arranged between the pair of substrates. Note that the conductive particles can be included in the sealant 4005.

Note that the structures of the electrodes of the liquid crystal element can be changed as appropriate in accordance with a display mode of the liquid crystal element.

This embodiment shows the example of the liquid crystal display device in which a polarizing plate is provided on the outer side of the substrate (on the viewer side) and a coloring layer and an electrode layer used for a display element are provided in this order on the inner side of the substrate; however, a polarizing plate may be provided on the inner side of the substrate. The stacked structure of the polarizing plate and the coloring layer is not limited to that shown in this embodiment and can be set as appropriate depending on materials of the polarizing plate and the coloring layer or conditions of the fabrication process. Further, a light-blocking film serving as a black matrix may be provided in a portion other than the display portion.

Each of the transistors 4010 and 4011 is composed of a gate insulating layer, a gate electrode layer, and a wiring layer (such as a source wiring layer and a capacitor wiring layer) in addition to the semiconductor layer.

The insulating layer 4020 is formed over the transistors 4010 and 4011. As the insulating layer 4020, a silicon nitride film is formed by RF sputtering, for example.

The insulating layer 4021 is formed as a planarizing insulating film. For the insulating layer 4021, an organic material having heat resistance, such as polyimide, acrylic, a benzocyclobutene-based resin, polyamide, or epoxy, can be used. Other than such organic materials, it is also possible to use a low-dielectric constant material (a low-k material), a siloxane-based resin, phosphosilicate glass (PSG), borophosphosilicate glass (BPSG), or the like. Note that the insulating layer 4021 may be formed by stacking a plurality of insulating films formed of these materials.

The pixel electrode layer 4030 and the counter electrode layer 4031 can be formed using a light-transmitting conductive material such as indium oxide containing tungsten oxide, indium zinc oxide containing tungsten oxide, indium oxide containing titanium oxide, indium tin oxide containing titanium oxide, indium tin oxide, indium zinc oxide, or indium tin oxide to which silicon oxide is added.

As the conductive high molecule, it is possible to use a so-called π-electron conjugated conductive polymer, for example, polyaniline or a derivative thereof, polypyrrole or a derivative thereof, polythiophene or a derivative thereof, or a copolymer of two or more of aniline, pyrrole, and thiophene or a derivative thereof.

A variety of signals and potentials are supplied to the source line driver circuit 4003 which is formed separately, the gate line driver circuit 4004, or the pixel portion 4002 from an FPC 4018.

A connection terminal electrode 4015 is formed using the same conductive film as the pixel electrode layer 4030 included in the liquid crystal element 4013. A terminal electrode 4016 is formed using the same conductive film as source and drain electrode layers of the transistors 4010 and 4011.

The connection terminal electrode 4015 is electrically connected to a terminal included in the FPC 4018 via an anisotropic conductive film 4019.

Although FIGS. 9A1, 9AB, and 9B show the example in which the source line driver circuit 4003 is formed separately and mounted on the first substrate 4001, this embodiment is not limited to this structure. The gate line driver circuit may be formed separately and then mounted, or only part of the source line driver circuit or part of the gate line driver circuit may be formed separately and then mounted.

This embodiment can be implemented in appropriate combination with any of the structures described in the other embodiments.

(Embodiment 3)

This embodiment will show the display mode of the liquid crystal element described in Embodiment 2. Although Embodiment 2 shows an example of the cross section of a twisted nematic (TN) mode liquid crystal element, the liquid crystal element can employ another display mode. Electrodes and substrates used for operating liquid crystal in various display modes will be described below with reference to schematic diagrams.

Figure 10:
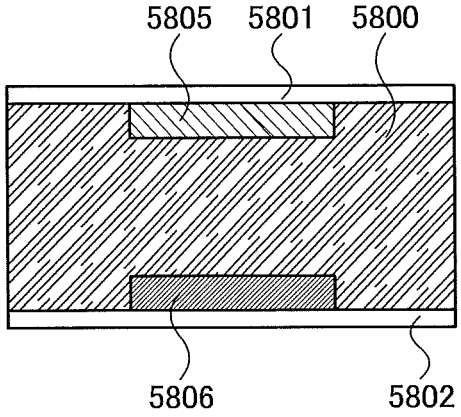
FIG. 10 is a cross-sectional view of a liquid crystal element in a liquid crystal display device in one embodiment of the disclosed invention.

FIG. 10 is a schematic diagram illustrating a cross section of a TN mode liquid crystal element.

A liquid crystal layer 5800 is sandwiched between a first substrate 5801 and a second substrate 5802 that are placed opposite to each other. A first electrode 5805 is formed on the first substrate 5801. A second electrode 5806 is formed over the second substrate 5802.

Figure 11A:
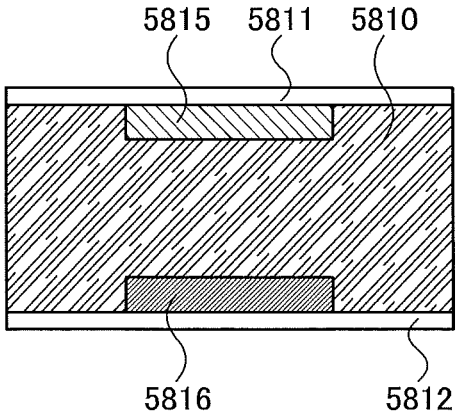
FIGS. 11A and 11B are cross-sectional views each illustrating a liquid crystal element in a liquid crystal display device in one embodiment of the disclosed invention.

FIG. 11A is a schematic diagram illustrating a cross section of a vertical alignment (VA) mode liquid crystal display device. In the VA mode, liquid crystal molecules are aligned vertically to the substrates when there is no electric field.

A liquid crystal layer 5810 is sandwiched between a first substrate 5811 and a second substrate 5812 that are placed opposite to each other. A first electrode 5815 is formed on the first substrate 5811. A second electrode 5816 is formed over the second substrate 5812.

Figure 11B:
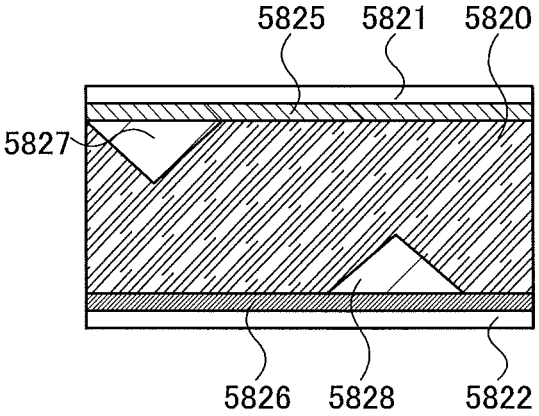

FIG. 11B is a schematic diagram illustrating a cross section of a multi-domain vertical alignment (MVA) mode liquid crystal display device. In the MVA mode, protrusions are provided so that liquid crystal molecules are aligned in a plurality of directions to compensate the viewing angle dependence.

A liquid crystal layer 5820 is sandwiched between a first substrate 5821 and a second substrate 5822 that are placed opposite to each other. A first electrode 5825 is formed on the first substrate 5821. A second electrode 5826 is formed over the second substrate 5822. A first protrusion 5827 for controlling alignment is formed on the first electrode 5825. A second protrusion 5828 for controlling alignment is formed over the second electrode 5826.

Figure 12A:
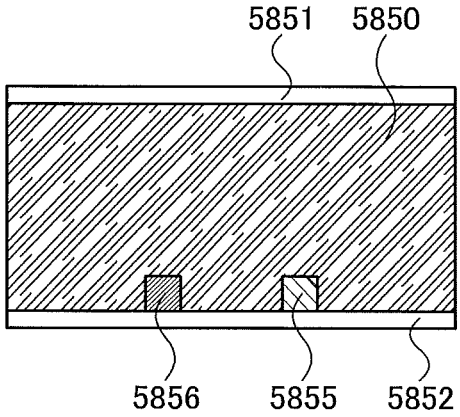
FIGS. 12A and 12B are cross-sectional views each illustrating a liquid crystal element in a liquid crystal display device in one embodiment of the disclosed invention.

FIG. 12A is a schematic diagram illustrating a cross section of an in-plane switching (IPS) mode liquid crystal display device. In the IPS mode, liquid crystal molecules always rotate in a plane parallel to substrates. The viewing angle dependence is small because of small difference in refractive index of a liquid crystal layer with varying angles for viewing a screen. The IPS mode employs a horizontal electric field mode for which electrodes are provided only on one substrate.

A liquid crystal layer 5850 is sandwiched between a first substrate 5851 and a second substrate 5852 that are placed opposite to each other. A first electrode 5855 and a second electrode 5856 are formed over the second substrate 5852.

For an electrode structure for a horizontal electric field mode such as the IPS mode, liquid crystal exhibiting a blue phase for which an alignment film is unnecessary may be used.

Figure 12B:
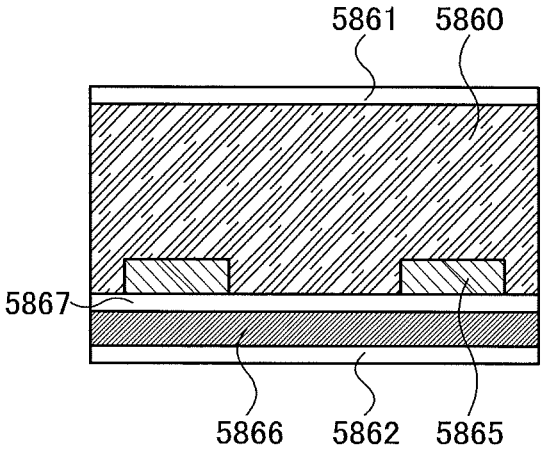

FIG. 12B is a schematic diagram illustrating a cross section of a fringe field switching (FFS) mode liquid crystal display device. In the FFS mode, liquid crystal molecules always rotate in a plane parallel to substrates. The viewing angle dependence is small because of small difference in refractive index of a liquid crystal layer with varying angles for viewing a screen. The FFS mode employs a horizontal electric field mode for which electrodes are provided only on one substrate.

A liquid crystal layer 5860 is sandwiched between a first substrate 5861 and a second substrate 5862 that are placed opposite to each other. A second electrode 5866 is formed over the second substrate 5862. An insulating film 5867 is formed over the second electrode 5866. A first electrode 5865 is formed over the insulating film 5867.

This embodiment can be implemented in appropriate combination with any of the structures described in the other embodiments.

(Embodiment 4)

In this embodiment, electronic devices including the liquid crystal display device described in any of the foregoing embodiments will be described. Examples of electronic devices include television sets, cameras such as video cameras and digital cameras, goggle-type displays, navigation systems, audio replay devices (e.g., car audio systems and audio systems), computers, game machines, portable information terminals (e.g., mobile computers, mobile phones, smartphones, portable game machines, e-book readers, and tablet terminals), and image replay devices provided with a recording medium (specifically, devices that are capable of replaying recording media such as digital versatile discs (DVDs) and equipped with a display device that can display an image). Specific examples of these electronic devices will be described with reference to FIGS. 13A to 13C, FIGS. 14A to 14C, and FIGS. 15A to 15C.

Figure 13A:
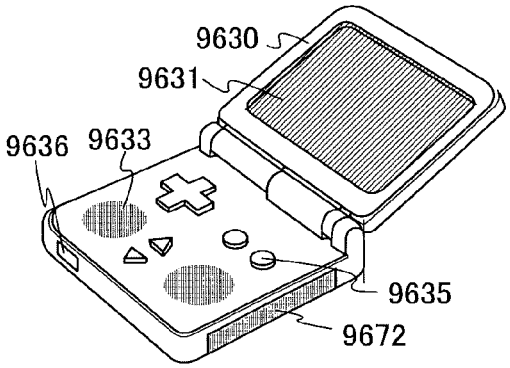
FIGS. 13A to 13C each illustrate an electronic device including a liquid crystal display device in one embodiment of the disclosed invention.

FIG. 13A illustrates a portable game machine that can include a housing 9630, a display portion 9631, a speaker 9633, operation keys 9635, a connection terminal 9636, a recording medium reading portion 9672, and the like. The portable game machine in FIG. 13A can have a function of reading a program or data stored in the recording medium to display it on the display portion, a function of sharing information with another portable game machine by wireless communication, and the like. Note that a function of the portable game machine in FIG. 13A is not limited to the above, and the portable game machine can have a variety of functions.

Figure 13B:
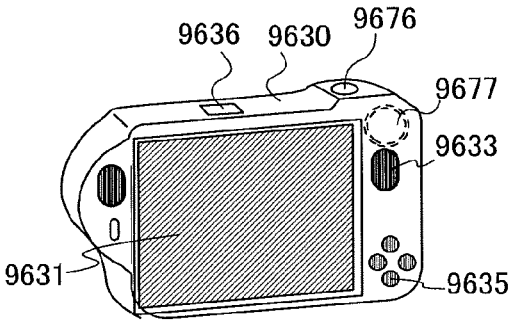

FIG. 13B illustrates a digital camera that can include a housing 9630, a display portion 9631, a speaker 9633, operation keys 9635, a connection terminal 9636, a shutter button 9676, an image receiving portion 9677, and the like. The digital camera in FIG. 13B can have a function of shooting a still image and/or a moving image, a function of automatically or manually correcting the shot image, a function of saving data such as the shot image, a function of displaying data such as the shot image on the display portion, and the like. Note that the digital camera in FIG. 13B can have a variety of functions without limitation to the above.

Figure 13C:
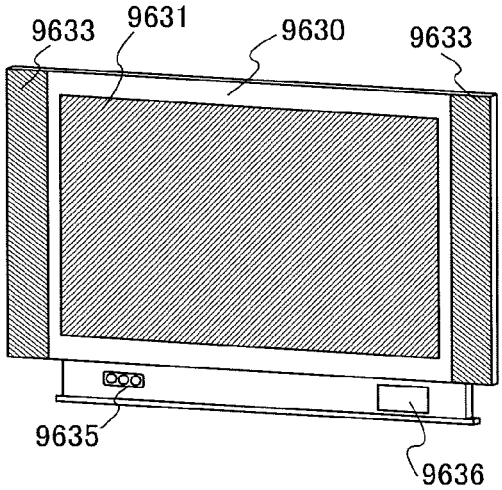

FIG. 13C illustrates a television set that can include a housing 9630, a display portion 9631, speakers 9633, operation key 9635, a connection terminal 9636, and the like. The television set in FIG. 13C has a function of converting an electric wave for television into an image signal, a function of converting an image signal into a signal suitable for display, a function of converting the frame frequency of an image signal, and the like. Note that the television set in FIG. 13C can have a variety of functions without limitation to the above.

In the case where a reset signal is input at the timing at which data for the entire screen of the display portion 9631 are rewritten as has been described in the above embodiment, the reset signal can be input when channels or input devices are switched or when a program goes to a commercial break.

Figure 14A:
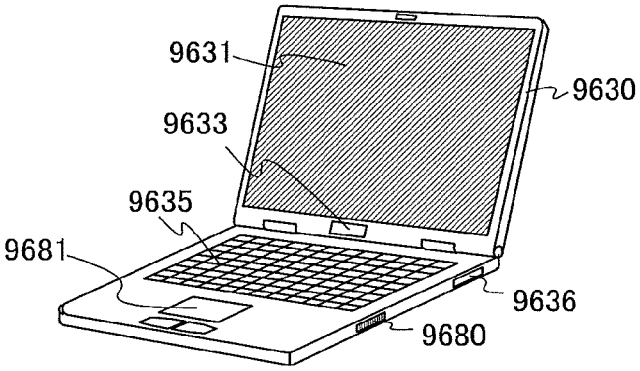
FIGS. 14A to 14C each illustrate an electronic device including a liquid crystal display device in one embodiment of the disclosed invention.

FIG. 14A illustrates a computer that can include a housing 9630, a display portion 9631, a speaker 9633, operation keys 9635, a connection terminal 9636, a pointing device 9681, an external connection port 9680, and the like. The computer in FIG. 14A can have a function of displaying various kinds of data (e.g., a still image, a moving image, and a text image) on the display portion, a function of controlling processing by various kinds of software (programs), a communication function such as wireless communication or wired communication, a function of being connected to various computer networks with the communication function, a function of transmitting or receiving a variety of data with the communication function, and the like. Note that the computer in FIG. 14A can have a variety of functions without limitation to the above.

Figure 14B:
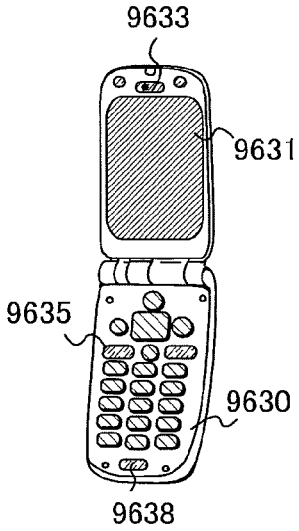

FIG. 14B illustrates a mobile phone that can include a housing 9630, a display portion 9631, a speaker 9633, operation keys 9635, a microphone 9638, an external connection port 9680, and the like. The mobile phone in FIG. 14B can have a function of displaying various kinds of data (e.g., a still image, a moving image, and a text image) on the display portion; a function of displaying a calendar, a date, the time, or the like on the display portion; a function of operating or editing the data displayed on the display portion; a function of controlling processing by various kinds of software (programs); and the like. Note that the functions of the mobile phone in FIG. 14B are not limited to those described above, and the mobile phone can have various functions.

Figure 14C:
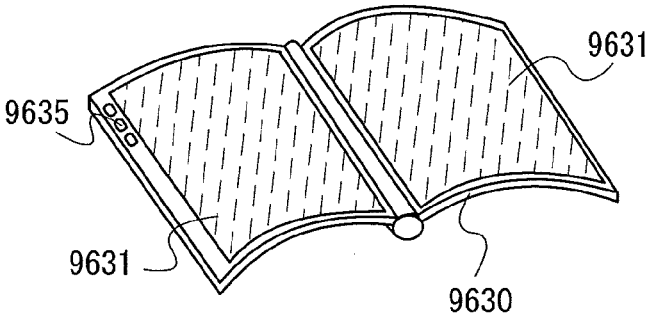

FIG. 14C illustrates an electronic device including electronic paper (also referred to as an eBook or an e-book reader) that can include a housing 9630, a display portion 9631, operation keys 9635, and the like. The e-book reader in FIG. 14C can have a function of displaying various kinds of data (e.g., a still image, a moving image, and a text image) on the display portion; a function of displaying a calendar, a date, the time, and the like on the display portion; a function of operating or editing the data displayed on the display portion; a function of controlling processing by various kinds of software (programs); and the like. Note that the e-book reader in FIG. 14C can have a variety of functions without limitation to the above functions.

Figure 15A:
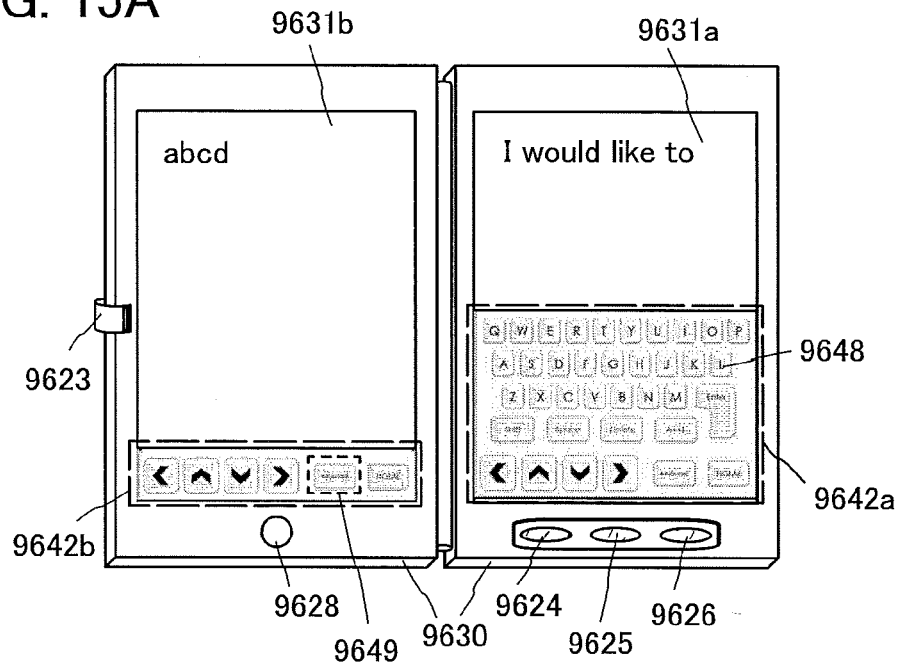
FIGS. 15A to 15C illustrate an electronic device including a liquid crystal display device in one embodiment of the disclosed invention.
Figure 15B:
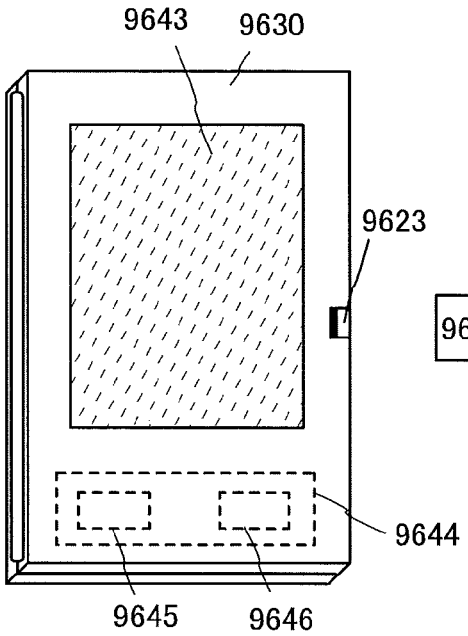

FIGS. 15A and 15B illustrate a tablet-type device (hereinafter referred to as "tablet") that can be folded in two. The tablet is open (unfolded) in FIG. 15A. The tablet includes a housing 9630, a display portion 9631*a*, a display portion 9631*b*, a switch 9624 for switching display modes, a power switch 9625, a switch 9626 for switching to power-saving mode, a fastener 9623, and an operation switch 9628.

Part of the display portion 9631*a* can be a touch panel region 9642*a*, and data can be input by touching operation keys 9648 that are displayed. Note that FIG. 15A shows, as an example, that half of the area of the display portion 9631*a* has only a display function and the other half of the area has a touch panel function. However, the structure of the display portion 9631*a* is not limited to this, and all the area of the display portion 9631*a* may have a touch panel function. For example, all the area of the display portion 9631*a* can display keyboard buttons and serve as a touch panel while the display portion 9631*b* can be used as a display screen.

Like the display portion 9631*a*, part of the display portion 9631*b* can be a touch panel region 9642*b*. When a finger, a stylus, or the like touches the place where a button 9649 for switching to keyboard display is displayed in the touch panel, keyboard buttons can be displayed on the display portion 9631*b*.

Touch input can be performed concurrently on the touch panel regions 9642*a* and 9642*b*.

The switch 9624 for switching display modes can switch display orientation (e.g., between landscape mode and portrait mode) and select a display mode (e.g., switch between monochrome display and color display), for example. With the switch 9626 for switching to power-saving mode, the luminance of display can be optimized in accordance with the amount of external light that an optical sensor incorporated in the tablet detects when the tablet is in use. The tablet may include another detection device such as a sensor for detecting orientation (e.g., a gyroscope or an acceleration sensor) in addition to the optical sensor.

Although FIG. 15A shows the example where the display area of the display portion 9631*a* is the same as that of the display portion 9631*b*, one embodiment of the present invention is not limited to this example. The display portions 9631*a* and 9631*b* may differ in size and/or image quality. For example, one of them may be a display panel that can display higher-definition images than the other.

FIG. 15B illustrates the tablet which is closed. The tablet includes the housing 9630, a solar battery 9643, a charge/discharge control circuit 9644, a battery 9645, and a DC to DC converter 9646. As an example, FIG. 15B illustrates the charge/discharge control circuit 9644 including the battery 9645 and the DC to DC converter 9646.

Since the tablet can be folded in two, the housing 9630 can be closed when the tablet is not in use. Thus, the display portions 9631*a* and 9631*b* can be protected, thereby providing a tablet with high endurance and high reliability for long-term use.

The tablet illustrated in FIGS. 15A and 15B can also have a function of displaying various kinds of data (e.g., a still image, a moving image, and a text image), a function of displaying a calendar, a date, the time, or the like on the display portion, a touch input function of operating or editing data displayed on the display portion by touch input, a function of controlling processing by various kinds of software (programs), and the like.

The solar battery 9643 attached on a surface of the tablet supplies power to the touch panel, the display portion, an image signal processor, and the like. The solar battery 9643 can be provided on one or both surfaces of the housing 9630, so that the battery 9645 can be charged efficiently. The use of a lithium ion battery as the battery 9645 brings an advantage such as the reduction in size.

Figure 15C:
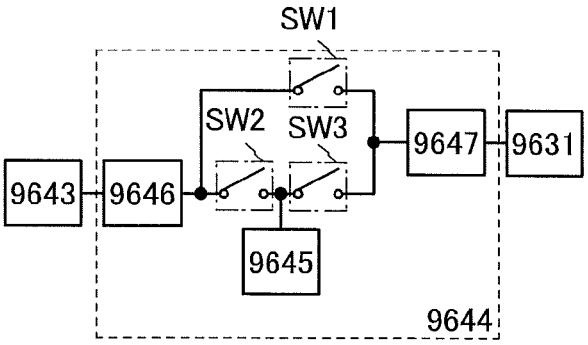

The structure and operation of the charge/discharge control circuit 9644 illustrated in FIG. 15B will be described with reference to a block diagram in FIG. 15C. FIG. 15C illustrates the solar battery 9643, the battery 9645, the DC to DC converter 9646, a converter 9647, switches SW1 to SW3, and the display portion 9631. The battery 9645, the DC to DC converter 9646, the converter 9647, and the switches SW1 to SW3 correspond to the charge/discharge control circuit 9644 illustrated in FIG. 15B.

An example of the operation performed when power is generated by the solar battery 9643 using external light is described. The voltage of power generated by the solar battery 9643 is raised or lowered by the DC to DC converter 9646 so as to be a voltage for charging the battery 9645. Then, when power from the solar battery 9643 is used for the operation of the display portion 9631, the switch SW1 is turned on and the voltage of the power is raised or lowered by the converter 9647 so as to be a voltage needed for the display portion 9631. When images are not displayed on the display portion 9631, the switch SW1 is turned off and the switch SW2 is turned on so that the battery 9645 is charged.

Although the solar battery 9643 is shown as an example of a power generation means, there is no particular limitation on a way of charging the battery 9645, and the battery 9645 may be charged with another power generation means such as a piezoelectric element or a thermoelectric conversion element (Peltier element). For example, the battery 9645 may be charged with a non-contact power transmission module that transmits and receives power wirelessly (without contact) to charge the battery or with a combination of other charging means.

The electronic device in this embodiment achieves low power consumption by including the liquid crystal display device described in any of the above embodiments.

This embodiment can be implemented in appropriate combination with any of the structures described in the other embodiments.

This application is based on Japanese Patent Application serial No. 2012-165630 filed with Japan Patent Office on Jul. 26, 2012, the entire contents of which are hereby incorporated by reference.

What is claimed is:

1. A liquid crystal display device comprising:

a pixel comprising a liquid crystal element; and a driver circuit configured to input a video signal to the pixel while making polarity of the video signal inverted every m frames (m is a natural number of 2 or more), and configured to input a reset signal to the pixel when the video signal is not input to the pixel, wherein a potential of the reset signal is higher than a common potential during a first period and is lower than the common potential during a second period.

2. The liquid crystal display device according to claim 1, wherein the potential of the reset signal is approximately the same as the common potential after the first period and the second period.

3. The liquid crystal display device according to claim 1, further comprising a backlight capable of emitting light to the pixel, wherein the driver circuit is configured to input the reset signal to the pixel when the backlight does not emit light.

4. A liquid crystal display device comprising:

a pixel comprising a liquid crystal element and a transistor electrically connected to the liquid crystal element; and a driver circuit configured to input a video signal to the pixel while making polarity of the video signal inverted every m frames (m is a natural number of 2 or more), and configured to input a reset signal to the pixel when the video signal is not input to the pixel, wherein the transistor comprises an oxide semiconductor layer comprising a channel formation region, and wherein a potential of the reset signal is higher than a common potential during a first period and is lower than the common potential during a second period.

5. The liquid crystal display device according to claim 4, wherein the potential of the reset signal is approximately the same as the common potential after the first period and the second period.

6. The liquid crystal display device according to claim 4, further comprising a backlight capable of emitting light to the pixel, wherein the driver circuit is configured to input the reset signal to the pixel when the backlight does not emit light.

7. A liquid crystal display device comprising:

a plurality of pixels each including a transistor and a liquid crystal element electrically connected to the transistor; and a driver circuit configured to input a video signal and a reset signal to each of the plurality of pixels, wherein the driver circuit is configured to input the video signal to each of the plurality of pixels while making polarity of the video signal inverted every m frames (m is a natural number of 2 or more), wherein the driver circuit is configured to input the reset signal to each of the plurality of pixels in a period during which the video signal is not input, and wherein the driver circuit is configured to input the reset signal to each of the plurality of pixels, wherein a potential of the reset signal is approximately the same as a common potential after a period during which the potential is higher than the common potential and a period during which the potential is lower than the common potential are repeated at least one time.

8. The liquid crystal display device according to claim 7, wherein the liquid crystal element comprises a pair of electrodes, and wherein after making a potential difference between the pair of electrodes of the liquid crystal element approximately 0 V by inputting the reset signal, the transistor is turned off.

9. The liquid crystal display device according to claim 7, wherein supply of power is interrupted after the driver circuit inputs the reset signal to all the plurality of pixels.

10. The liquid crystal display device according to claim 7, further comprising a backlight capable of emitting light to the plurality of pixels, wherein the driver circuit is configured to input the reset signal to each of the plurality of pixels when the backlight does not emit light.

11. The liquid crystal display device according to claim 7, wherein the driver circuit is configured to input the reset signal to each of the plurality of pixels at the same time as when data in all the pixels are rewritten.

12. The liquid crystal display device according to claim 7, further comprising a timer configured to activate the liquid crystal display device at a set time, wherein the driver circuit is configured to input the reset signal to each of the plurality of pixels when the liquid crystal display device is activated from a power-off state by the timer.

13. The liquid crystal display device according to claim 7, wherein the transistor comprises an oxide semiconductor.

* * * * *